US005141346A

United States Patent [19]

Nakagawa

[11] Patent Number: 5,141,346

[45] Date of Patent: Aug. 25, 1992

[54] SHEET FEEDER HAVING AUTOMATIC CUT-SHEET FEED, CONTINUOUS-FORM FEED, AND MANUAL SHEET INSERTION MODES

[75] Inventor: Shin Nakagawa, Nagoya, Japan

[73] Assignee: Brother Kogyo Kabushiki Kaisha, Nagoya, Japan

[21] Appl. No.: 720,029

[22] Filed: Jun. 24, 1991

[30] Foreign Application Priority Data

Jun. 28, 1990 [JP] Japan ..... 2-172291
Jun. 29, 1990 [JP] Japan ..... 2-173962

[51] Int. Cl.[5] ..... B41J 13/10

[52] U.S. Cl. ..... 400/605; 400/624; 400/634; 400/636; 400/54; 271/9; 271/110; 271/114; 271/117; 271/118; 271/213

[58] Field of Search ..... 400/578, 605, 616, 624, 400/625, 634, 636, 54; 271/3, 292, 117, 118, 114, 110, 213

[56] References Cited

U.S. PATENT DOCUMENTS 4,540,297 9/1985 Imaizumi et al. ..... 400/605
4,854,757 8/1989 Kikuchi ..... 400/624
4,859,098 8/1989 Kawashima et al. ..... 400/616
4,913,674 4/1990 Yokoi ..... 400/605
4,929,104 5/1990 Yokoi ..... 400/605
4,995,745 2/1991 Yokoi ..... 400/605
5,026,184 6/1991 Dürr et al. ..... 400/605
5,073,055 12/1991 Takagi et al. ..... 400/605

FOREIGN PATENT DOCUMENTS 63-13011 4/1988 Japan .

*Primary Examiner*—Eugene H. Eickholt
*Attorney, Agent, or Firm*—Kane, Dalsimer, Sullivan, Kurucz, Levy, Eisele and Richard

[57] ABSTRACT

An automatic sheet feeder assembled to a printer which is provided with a sheet feed means for feeding a continuous-form sheet. The sheet feeder includes a hopper for storing therein a stack of cut sheets and a pivotable stacker for storing therein a stack of printed cut sheets. The stacker has operative position for receiving the cut sheets therein and has a spaced position for allowing the continuous form sheet to be printed. Detecting means is provided for detecting pivotal position of the stacker, and control means is provided for feeding the continuous form sheet when the stacker is out of the operative position responsive to the position of the stacker. A sheet feed mechanism is provided for feeding the cut sheets on the hopper to the printer. The sheet feed mechanism becomes inoperative when the continuous-form sheet is to be printed.

20 Claims, 18 Drawing Sheets

SHEET FEEDER HAVING AUTOMATIC CUT-SHEET FEED, CONTINUOUS-FORM FEED, AND MANUAL SHEET INSERTION MODES

BACKGROUND OF THE INVENTION

The present invention relates to an automatic sheet feeder having a hopper and a stacker, and more particularly to an automatic sheet feeder capable of switching sheet feed mode between an automatic sheet feeding mode in which the automatic sheet feeder operates to feed a sheet automatically and a mode in which a continuous-form sheet or a manually inserted sheet is printed.

Heretofore, in a printer capable of performing printing on a continuous-form sheet, a plurality of cut sheets can also be subjected to continuous printings. In the latter case, an automatic sheet feeder having a hopper and a stacker is detachably secured to the printer. The hopper is adapted to be arranged to store cut sheets in a stacking state and to supply each one of the cut sheet to a print assembly of the printer. The stacker is adapted to store cut sheets in a stacking state after the cut sheets are printed and discharged from the print assembly.

In accommodating the printed cut sheets on the stacker with a stacking mode, a plurality of the printed cut sheets can be automatically stacked or ordered one by one from a small number of pages to the large number of pages, if a print image surface of each of the printed cut sheets faces downwardly, and subsequent printed cut sheets are continuously stacked one by one onto the non-printed surface of the precedent printed cut sheets.

In order to provide a stacker for such automatic page order printings, conventionally, the hopper is disposed rearwardly of a sheet discharge port, and the stacker is disposed in front of the sheet discharge port. Further, an upper end of the stacker is positioned frontwardly and is directed upwardly. Thus, generally V-shaped layout is provided when viewing the stacker and the hopper from a side of the printer.

However, as described above, in the V-shape arrangement of the hopper and the stacker, if the stacker is positioned at its lower position positioned adjacent the sheet discharge port of the printer, the following problems may be caused when printing to the continuous-form sheet.

That is, in case of the printing operation to the continuous-form sheet, a cutter member (having an elongated plate shape) is provided at the sheet discharge port positioned above a platen in order to cut the continuous-form sheet after printing. The continuous-form sheet passes at a rear surface of the cutter member, and a front surface of the continuous-form sheet abuts an upper edge of the cutter member when the continuous-form sheet is pulled frontwardly and is cut in transverse direction thereof.

Accordingly, the stacker obstructs a way of the continuous-form sheet which passes beside the rear surface of the cutter member and is directed upwardly. Thus, the continuous-form sheet must be pulled out frontwardly of the printer, and the cutting operation to the continuous-form sheet cannot be smoothly performed.

In order to eliminate these drawbacks, according to a conventional arrangement, the automatic sheet feeder is detached from the printer in case of printing to the continuous-form sheet, which is troublesome, and incurs difficulty since the detached automatic sheet feeder must temporarily be stored in a given location.

One typical example of an automatic sheet feeder for use in a printer is disclosed in a commonly assigned copending U.S. patent application Ser. No. 07/615,172 filed on Nov. 19, 1990 now U.S. Pat. No. 5,118,090. The disclosed automatic sheet feeder includes a stacker which can be retracted from the sheet discharge slot of a printer. When the stacker is retracted, there is defined a path for a manually inserted sheet or a continuous-form sheet.

Further, according to the sheet feeder disclosed in the copending application and used in a printer capable of performing printing to a continuous-form sheet, a plurality of cut sheets can be continuously printed by an automatic sheet feeder. The disclosed device includes a sheet feed roller for feeding cut sheets stacked in a hopper to a platen of a printer and intermediate roller pair disposed between the sheet feed roller and the platen. A drive source such as a stepper motor is disposed in the printer for driving the platen etc., and a gear transmission mechanism is provided for transmitting power to the sheet feed roller etc. from the drive source.

According to the arrangement in which the drive source of the printer is transmitted to the automatic sheet feeder, if the printing to the continuous-form sheet is carried out while the automatic sheet feeder is assembled to the printer, the sheet feed roller etc. are automatically rotated, so that the cut sheets accommodated in the hopper are fed to the print assembly. To avoid this drawback, it is necessary to shut off the power transmission to the automatic sheet feeder in case of the printing to the continuous-form sheet.

Further, the stacker which accommodates therein printed cut sheets must be moved away from the sheet discharge slot positioned above the print assembly, otherwise it becomes difficult to pull out the printed continuous-form sheet from the sheet discharge slot due to the existence of the stacker.

Furthermore, according to the related invention disclosed in the copending U. S. Patent Application, for printing to the cut sheets, the platen, the sheet feed roller and the intermediate roller pair are rotated in normal direction for nipping a leading end portion of the cut sheet between the platen and a pinch roller in contact therewith. Next, the rotations of these rollers are intermittently stopped for a short period of time, and then, platen is reversely rotated while the intermediate roller pair are normally rotated in a short period. Thus, flexed or slackened portion is provided at the leading end portion of the cut sheet between the platen and the intermediate roller pair because of the sheet feeding motion of the intermediate roller pair. By this flexed or slackened portion of the cut sheet, leading edge of the cut sheet can be oriented approximately in parallel with an axial direction of the platen, and can be obtained a generally constant contacting angle of the leading end portion of the cut sheet with respect to a contact portion between the platen and the pinch roller.

Accordingly, if the platen and the intermediate roller pair are again rotated in the normal direction, the leading end portion of the cut sheet nipped between the platen and the pinch roller is fed toward the print head with generally constant feed amount of the leading end portion. Therefore, print start position can be precisely provided on the cut sheet, and a printing line can be directed in parallel with a leading edgeline of the cut sheet.

As described above, drive force from the platen side (printer side) is transmitted to the intermediate roller pair through a gear transmission mechanism. In this case, the intermediate roller pair are rotatable in a normal direction regardless of the switching of the rotational direction of the platen. However, the present inventor has found necessity in improvement on the related invention described in the copending U.S. Patent application, now U.S. Pat. No. 5,118,090.

SUMMARY OF THE INVENTION

Based on the finding that in the automatic sheet feeder with a stacker, the stacker is always used in an operative position insofar as an automatic sheet feeding mode is selected, it is an object of the present invention to provide a mode switching mechanism suitable for use in such an automatic sheet feeder.

Another object of the invention to provide the automatic sheet feeder capable of easily achieving switching between the printing to the cut sheets and printing to the continuous-form sheet.

Still another object of the invention is to provide the automatic sheet feeder in which the print mode switching operation can be made without any detachment of the sheet feeder from a printer.

Still another object of the invention is to provide such automatic sheet feeder having improved gear transmission mechanism capable of providing timed rotation of intermediate roller pair with a rotation of the platen in order to maintain an initially provided sheet slack at a leading end portion of a cut sheet.

These and other objects of the present invention will be attained by providing an automatic sheet feeder for use in a printer which includes a drive source, a sheet insertion section, a printing section, a sheet feed means for feeding a continuous-form sheet and a sheet discharge section, the sheet feeder including a hopper in which a stack of cut sheets are stored, and a stacker for storing printed cut sheets thereon, the automatic sheet feeder providing a first sheet feed mode for supplying the cut sheet stored in the hopper to the sheet insertion section and a second sheet feed mode for supplying a sheet other than the sheet in the hopper, the automatic sheet feeder comprising: (a) the stacker provided pivotably movable between an operative position where the stacker is positioned adjacent to the sheet discharge section of the printer for receiving in the stacker the printed cut sheet printed at the printing section and a spaced position away from the sheet discharge section, (b) detecting means for detecting the operative position of the stacker, the detecting means providing a first signal indicative of the operative position of the stacker and a second signal indicative of the position of the stacker other than the operative position, and (c) means for providing the second sheet feed mode when the stacker is out of the operative position in response to the second detection signal from the detecting means.

In another aspect of the invention, there is provided an automatic sheet feeder for use in a printer having a print assembly, a drive source and sheet feed means which supplies a continuous-form sheet to the print assembly comprising: (a) a side frame, (b) a hopper supported on the side frame for accommodating cut sheets in a stack and having a sheet feed mechanism for supplying the cut sheet one by one to the print assembly, (c) a stacker for accommodating printed cut sheets, the hopper and the stacker being assembled to the printer, (d) a gear transmission mechanism for rotatably driving the sheet feed mechanism by the drive source of the printer, (e) position control means provided on the side frame for regulating upward and downward pivotal positions of the stacker, and (f) an interlink mechanism for achieving ON/OFF control with respect to a power transmission to the sheet feed mechanism through the gear transmission mechanism in accordance with a movement of the position control means.

The detecting means includes, for example, a microswitch, and the means for providing the second sheet feed mode includes, for example, an electromagnetic clutch connected to the sheet feed mechanism such as a sheet feed roller positioned in confrontation with a stack of cut sheets held in the hopper. When the stacker is positioned in the operative position (lowermost position), the microswitch is rendered ON, so that the electromagnetic clutch is energized to rotate the sheet feed roller. Therefore, the first mode, i.e., automatic cut-sheet feed mode is provided. On the other hand, if the stacker is pivotally moved to the upward spaced position, the microswitch is rendered OFF, to thereby render the sheet feed roller unrotatable. Thus, automatic sheet feed mode is shut-off. In this case, the continuous-form sheet feed mode, or manual sheet insertion mode is selected upon manipulation to a mode select switch of the printer.

More specifically, when the cut sheet held in the hopper is to be printed, the stacker is moved into the operative position near the sheet discharge section of the printer. The detecting means detects the position of the hopper, initiating the first mode (automatic sheet feeding mode) which makes it possible to actuate a sheet feeding mechanism. The sheet held in the hopper is fed to a sheet insertion section of the printer, and the sheet printed by the printer is discharged from the sheet discharge section positioned adjacent the stacker.

When a sheet is to be manually inserted or a continuous-form or fan-fold sheet is to be printed, the stacker is displaced into a retracted position, defining a path for the manually inserted sheet or the continuous-form sheet. At this time, the detecting means detects the position of the hopper, and quitting the first mode, disabling the sheet feeding mechanism. Therefore, when the manually inserted sheet or the continuous-form sheet is printed, any sheet held in the hopper is not fed.

DETAILED DESCRIPTION OF THE PREFERRED EMBODIMENTS

Figure 1:
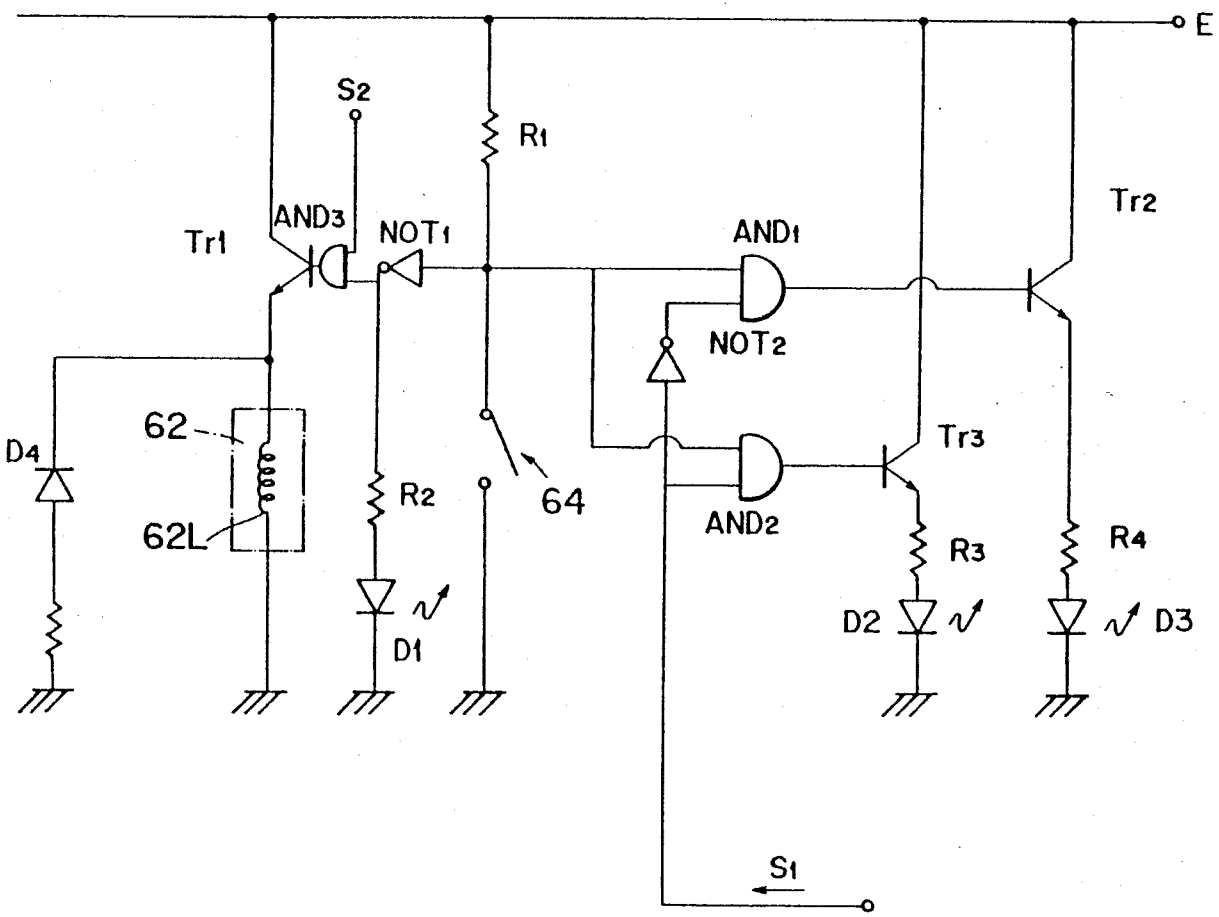
FIG. 1 is a block diagram showing an electric arrangement of a printer according to an embodiment of the present invention.
Figure 2:
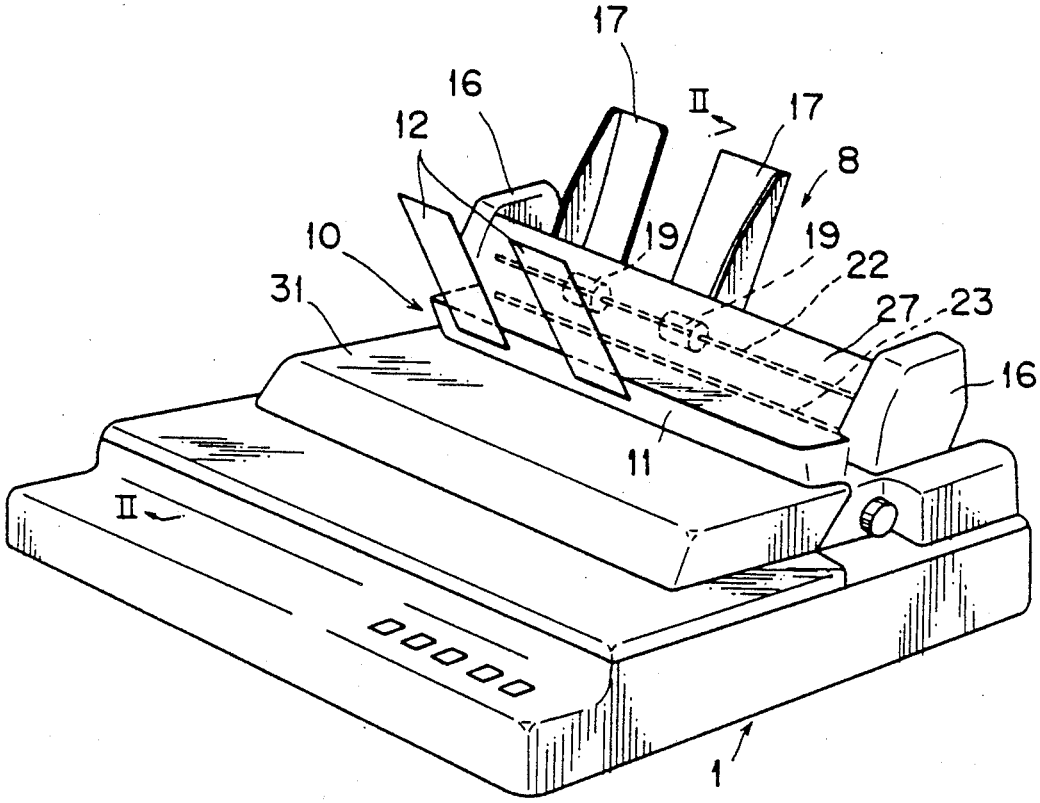
FIG. 2 is a perspective view showing a printer and an automatic sheet feeder according to an embodiment of the present invention.

An embodiment of the present invention will now be described with reference to FIGS. 1 through 18. A printer 1 has a frame 2 and a print assembly 3 which includes a roller-shaped platen 4 and a print head 5 that faces a front surface of the platen 4. A ribbon cassette RC housing an ink ribbon (not shown) is detachably mounted in front of the print head 5, with the ink ribbon interposed between the print head 5 and the platen 4.

A continuous-form sheet is fed to the platen 4 by a pin roller 6 and a pin tractor 7. The platen 4, the pin roller 6, and the pin tractor 7 are rotated in synchronism by a drive source or step motor (not shown) which is mounted in the printer 1. In single-sheet printing modes (including an automatic sheet feeding mode and a manual sheet inserting mode, described later on), the transmission of drive power from the step motor is cut off by a control switch on a control panel.

An automatic sheet feeder 8 is disposed upwardly of the print assembly 3. The automatic sheet feeder 8 comprises a hopper 9 for storing a stack of separate sheets P and feeding the sheets P, one by one, to the print assembly 3 through a sheet insertion slot EN behind the platen 4. After sheets P are printed, they are discharged from a sheet discharge slot DI above the print assembly 3 and stacked on a stacker 10. The hopper 9 extends upwardly and rearwardly above an upper surface of the printer 1. The stacker 10 has a tray 11 on which ends of a plurality of sheet support arms 12 are detachably mounted, the sheet support arms 12 having upper ends extending forwardly and upwardly.

The automatic sheet feeder 8 has a pair of laterally spaced support members or side frames 13 whose rear portions are interconnected by a laterally elongate rear frame 14. Arms 15 in the form of metal plates extend forwardly and downwardly from the lower ends of the side frames 13 and have bifurcated distal ends 15*a* disengageably fitted over a support shaft 4*a* of the platen 4.

The hopper 9 includes a pair of laterally spaced sheet guides 17 extending rearwardly and upwardly, or tilted rearwardly, on a front surface of the rear frame 14. At least one of the sheet guides 17 is movable transversely (laterally) across the sheets P. When a stop lever 18 that is angularly movably attached to the back of the movable sheet guide 17 is pressed against the rear frame 14, the movable sheet guide 17 is held in position after it has moved laterally.

A sheet feed roller 19 is held against an upper surface of the stacked sheets P on the hopper 9. The stacked sheets P are fed, one by one, to the print assembly 3 by the sheet feed roller 19 and a pair of intermediate rollers 20, 21. The sheet feed roller 19 and the intermediate rollers 20, 21, which serve as a sheet feed mechanism, are mounted on shafts 22, 23, 24, respectively, extending between the side frames 13. The sheet feed roller 19 and the intermediate rollers 20, 21 are rotated by the drive source in the printer 1 through a first gear transmission mechanism 25 mounted on a side of the side frame 13, shown on the right, and a second gear transmission mechanism 26 mounted on a side of the side frame 13, shown on the left. The gear transmission mechanisms 25, 26 are covered with respective side covers 16.

The automatic sheet feeder 8 includes a front wall plate 27 and sheet guides 28, 29 for guiding a sheet P toward the platen 4. A flexible film FB has one end bonded to the rear frame 14 and the other end disposed closely to the sheet guide 28. The film FB cooperates with the sheet insertion slot and the sheet guide 28 in guiding a sheet P from the hopper 9 into the sheet insertion slot EN behind the platen 4. A printed continuous-form sheet PL is cut off by a laterally elongate cutter 30 which is mounted on a swing arm 32. In the sheet discharge slot DI above the print assembly 3, the cutter 30 on the swing arm 32 can be angularly moved between a position close to the front surface of the platen 4 and a position away from the front surface of the platen 4. A detachable front cover 31 for covering an upper front potion of the printer 1 is disposed in covering relation to the print head 5 and the ribbon cassette.

A pinch roller 33 is positioned adjacent to the sheet guide 29 below the platen 4, the pinch roller 33 being held against the outer circumferential surface of the platen 4. A reflective-type photosensor 34 is attached to a lower surface of the sheet guide 29 for detecting when the leading end of a sheet P approaches a nipping region between the platen 4 and the pinch roller 33. The photosensor 34 detects arrival of a sheet P in response to light reflected by the surface of the sheet P, and produces an output signal that is applied to a control unit 63, which starts to count pulses to be applied to the step motor in order to control the reversible rotation of a platen gear, described below.

Figure 19:
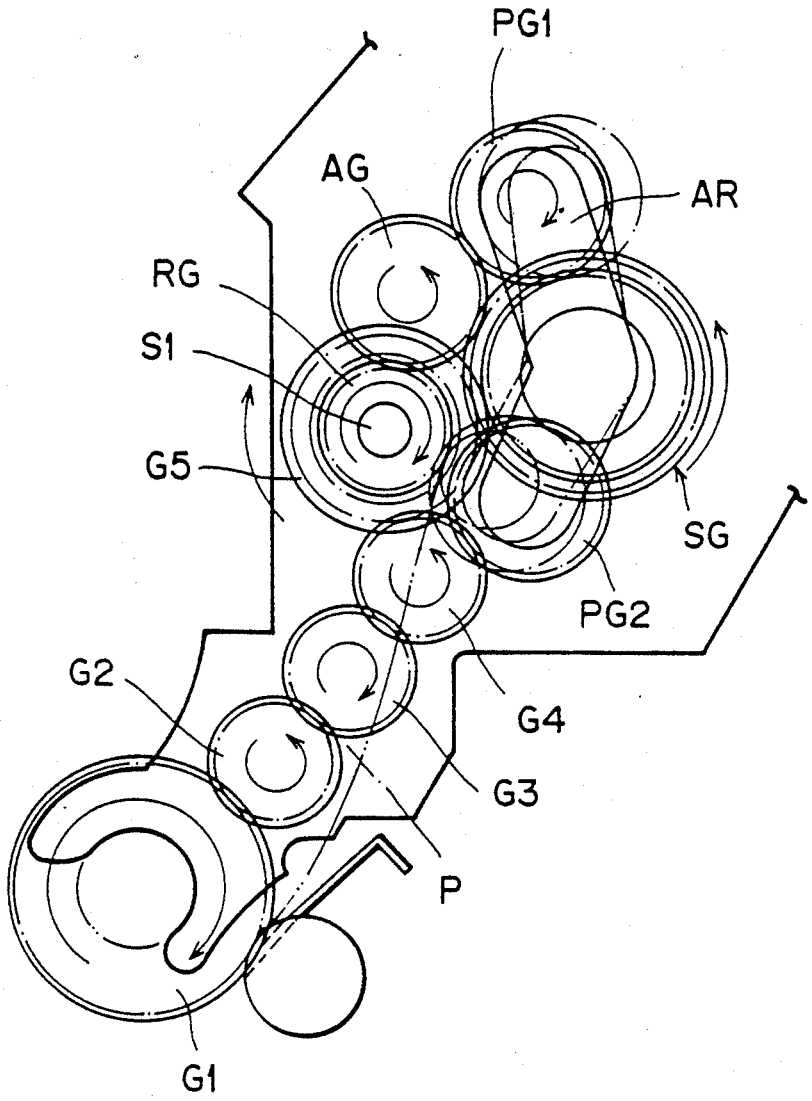
FIG. 19 RELATED ART
FIG. 19 is a side view showing a gear transmission arrangement according to a related invention described in a copending U.S. patent application Ser. No. 615,172.
Figure 20:
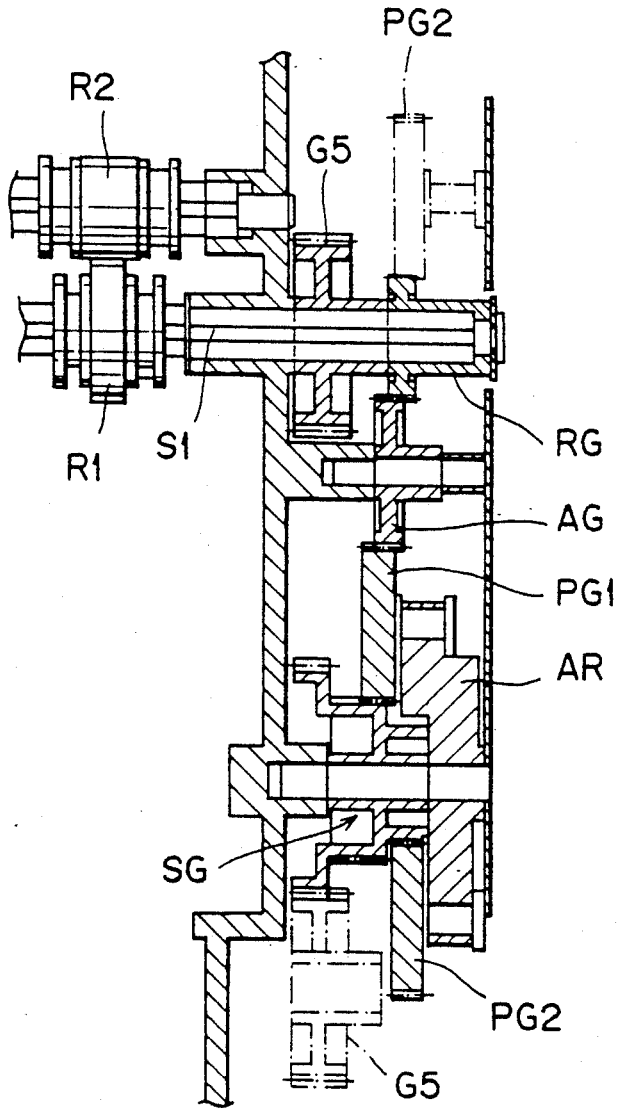
FIG. 20 RELATED ART
FIG. 20 is a cross-sectional view showing the gear transmission arrangement according to the related invention.

According to the related invention disclosed in the copending U.S. patent application, as described above, drive force from the platen side (printer side) is transmitted to the intermediate roller pair through a gear transmission mechanism. In this case, the intermediate roller pair are rotatable in a normal direction regardless of the switching of the rotational direction of the platen. To this effect, in the related invention described in the copending application, a gear transmission mechanism shown in FIGS. 19 and 20 are provided. According to the gear transmission mechanism in the related invention and disclosed in the above described copending U.S. Patent Application, rotation of a platen gear G1 provided at one side of the platen and rotatable together with the platen is transmitted to an intermediate idle gear G5 idly mounted on a shaft S1 of one rollers R1 of the intermediate rollers R1, R2, through transmission gears G2, G3, G4. The intermediate idle gear G5 is meshedly engaged with a large stage gear portion of a three-stage sun gear SG. Further, a swing arm AR is pivotally provided to a shaft S2 of the sun gear SG, and end portions of the swing arm AR are rotatably provided with a first planetary gear PG1 always in meshing engagement with an intermediate stage gear portion of the sun gear SG and with a second planetary gear PG2 always in meshing engagement with a small stage gear portion of the sun gear SG.

When the platen gear G1 is rotated in a normal direction (clockwise direction in FIG. 19), the sun gear SG is rotated in counterclockwise direction, so that the first planetary gear PG1 is rotated about its axis while moving around the sun gear. The first planetary gear PG1 is brought into meshing engagement with an idle gear AG, and by the rotation of the idle gear AG, an intermediate roller gear RG is rotated. The intermediate roller gear RG is mounted on the shaft S1 through a key for rotation together with the shaft S1. Thus, the intermediate roller gear RG is rotated in a normal direction. In this case, because of the inclination of the swing arm AR, the second planetary gear PG2 is disengaged from the intermediate roller gear RG. Accordingly the cut sheet can be fed to the platen.

Reversely, when the platen gear G1 is reversely rotated (counterclockwise direction in FIG. 19), the sun gear SG is rotated in the clockwise direction, so that the second planetary gear PG2 is rotated about its axis while moving around the sun gear SG and is brought into engagement with the intermediate roller gear RG as shown by two dotted chain line in FIG. 19. Thus, the intermediate roller gear RG is rotated in a normal direction. Because of the reversal rotation of the platen and normal rotation of the intermediate roller, flexed or slackened portion is provided in the cut sheet. In this case, the swing arm AR is angularly moved in a clockwise direction, the first planetary gear PG1 is disengaged from the idle gear AG.

Then, in order to direct the leading end of the cut sheet P to the print head, the platen gear G1 and the intermediate roller pair are both rotated in normal direction. For this, the swing arm AG must be angularly moved so that the platen gear G1 can be rotated in the normal direction and the second planetary gear PG2 can be moved away from the intermediate roller gear RG while the first planetary gear PG1 can be moved toward the idle gear AG to engage the idle gear. However, such sheet feeding operation cannot be promptly achieved due to the resiliency of the cut sheet which has been flexed or bent.

More specifically, the leading end portion of the sheet has been flexed or slackened, but the sheet has resiliency to restore its linear orientation particularly if the sheet having high stiffness, such as a thick sheet, is employed. Therefore, the sheet has its inherent resiliency to reduce its flex, so that the sheet is urged rearwardly. Due to this sheet resiliency, the intermediate roller pairs R1 and R2 which nip the sheet are subjected to rotational moment so as to rotate the roller pairs in the opposite direction. This rotational moment is directly transmitted to the second planetary gear PG2 engaged with the intermediate roller gear RG. Thus, the second planetary gear PG2 is rotated in the clockwise direction in FIG. 19. Even though the sun gear SG is rotated in the counterclockwise direction in order to disengage the second planetary gear PG2 from the intermediate roller gear RG, the rotational moment applied to the intermediate roller prevents the second planetary gear PG2 from being disengaged from the intermediate roller gear PG2. Thus, these opposite forces may provide a force-balance for a short period, which cannot promptly provide normal rotation of the intermediate roller gear RG.

That is, if the force-balance is provided, the intermediate roller gear RG and the second planetary gear PG2 are engaged with each other. Therefore, even if the sun gear SG is rotated in the counterclockwise direction, the second planetary gear PG2 cannot be moved around the sun gear SG, and accordingly, the first planetary gear PG1 cannot be promptly brought into engagement with the idle gear AG, to render the rotation of the intermediate roller gear RG in the normal direction impossible.

When the rotation of the platen gear G1 is changed from its reversal rotation to the normal rotation, the second planetary gear PG2 must be promptly disengaged from the intermediate roller gear RG. However, due to the above described reason, the disengagement timing is delayed, and therefore, the sheet slack which can be provided by the reversal rotation of the platen gear is inadvertently reduced. In other words, the normal rotation of the intermediate roller pair cannot be started until the sheet slack is reduced to a certain level. Thus, optimum sheet slack level which has been provided by the reversal rotation of the platen gear is inadvertently reduced. Further, normal rotation timing of the intermediate roller pair is delayed or retarded. As a result, the sheet is subjected to tensile force, since the platen and the pinch roller urge the sheet frontwardly whereas the intermediate roller pair prevents the sheet from its frontward feeding. Consequently, intended top margin cannot be provided at the time of actual printing operation, and insufficient printing results. The depicted embodiment can provide improvement over the invention described in the copending U.S. patent application.

Figure 5:
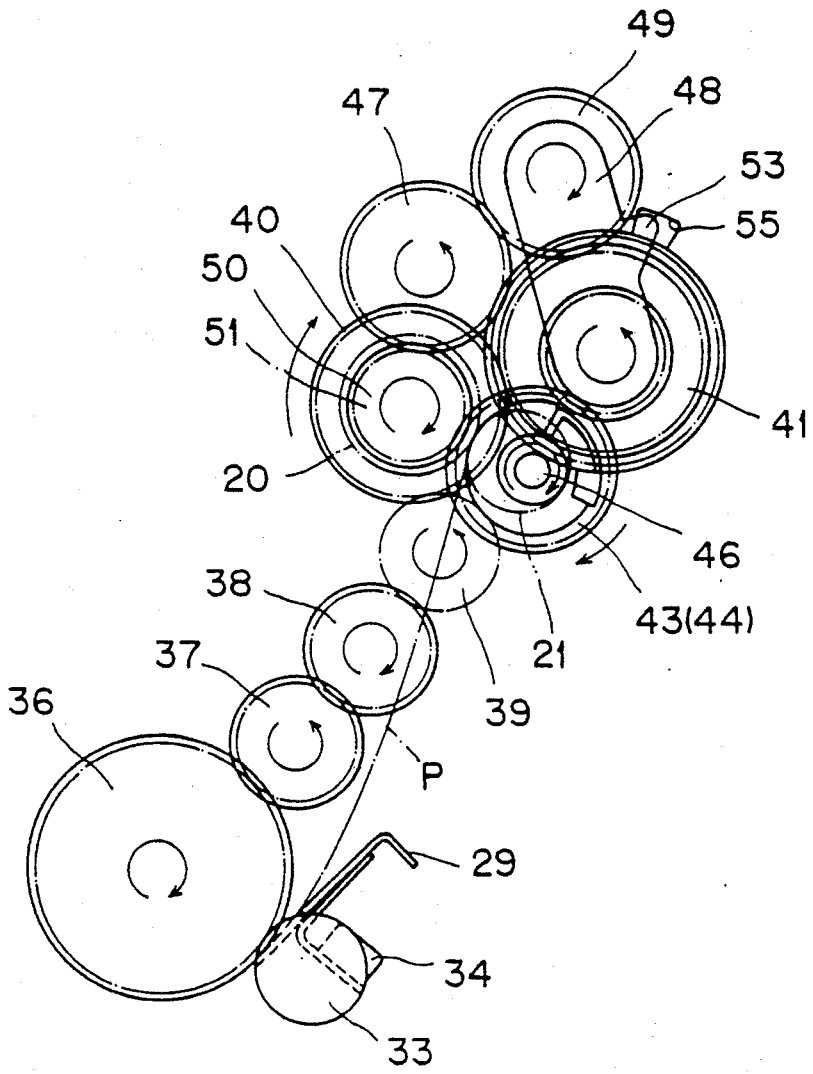
FIG. 5 is a side elevational view showing a first gear transmission mechanism.
Figure 6:
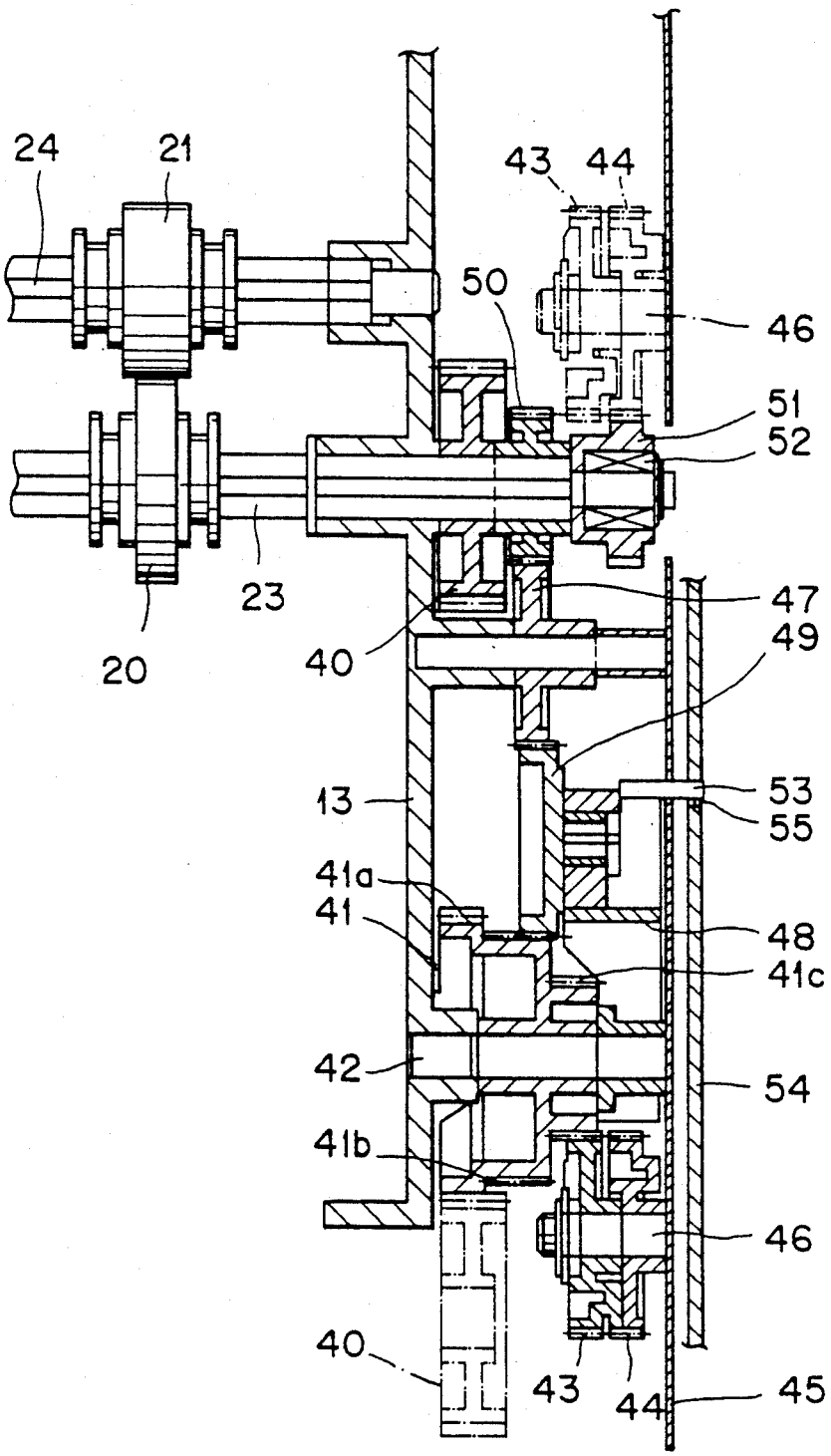
FIG. 6 is a cross-sectional view showing the first gear transmission mechanism.

The first gear transmission mechanism 25 of the present embodiment shown in FIGS. 5 and 6 will be described below. A platen gear 36 is fixed to the shaft 4*a* of the platen 4, and is reversibly rotated by the step motor. The platen gear 36 is held in mesh with a group of transmission gears 37, 38, 39 for transmitting rotative power to rotate an intermediate idle gear 40 that is idly rotatably fitted over a shaft 23 on which one of the intermediate rollers 20 is fixedly mounted.

A sun gear assembly 41 which has three gears, i.e., a larger-diameter gear 41*a*, a medium-diameter gear 41*b*, and a smaller-diameter gear 41*c*, is rotatably supported on a shaft 42. The intermediate idle gear 40 is held in mesh with the larger-diameter gear 41*a* at all time.

The smaller-diameter gear 41*c* of the sun gear assembly 41 is held in mesh with a main idle gear 43 which is rotatable in unison with an auxiliary idle gear 44. The main and auxiliary idle gears 43, 44 are idly rotatably fitted over a shaft 46 mounted on a support plate 45. Over the sheet 42 of the sun gear assembly 41, there is swingably fitted a swing arm 48 supporting a swing gear 49 that is rotatable about its own axis by mesh with the medium-diameter gear 41*b* of the sun gear assembly 41, the swing gear 49 being also revolvable about the shaft 42.

An intermediate roller gear 50 is fixedly mounted on the shaft 23 of the intermediate roller 20. A transmission gear 51 with a one-way clutch 52 is also mounted on the shaft 23. When the transmission gear 51 rotates clockwise in FIG. 5 (i.e., when the platen 4 is reversed), the one-way clutch 52 is actuated to transmit the rotative power to the shaft 23. When the transmission gear 51 rotates counterclockwise (i.e., when the platen 4 rotates normally), the one-way clutch 52 idly rotates to block the transmission of the rotative power to the shaft 23. The auxiliary idle gear 44 is in mesh with the transmission gear 51 coined with the one-way clutch 52. When the swing arm 48 swings counterclockwise, the swing gear 49 mounted thereon moves into mesh with an idle gear 47 that is held in mesh with the intermediate roller gear 50 at all times.

With this arrangement, when the platen 4 and the platen gear 36 rotate normally (i.e., clockwise as indicated by the solid-line arrow in FIG. 5, in a direction to feed a sheet P), the sun gear assembly 41 rotates counterclockwise, and the swing gear 49 as it rotates about its own axis moves into mesh with the idle gear 47, thereby rotating the intermediate roller gear 50 clockwise. Therefore, the intermediate roller 20 rotates normally (in the direction to feed a sheet) through the shaft 23. At this time, the transmission gear 51 is rotated counterclockwise by the sun gear assembly 41 through the main idle gear 43 and the auxiliary idle gear 44, but is disconnected from the shaft 23 by the one-way clutch 52.

Conversely, when the platen gear 36 is reversed (i.e., rotated counterclockwise as indicated by the arrow in FIG. 7), the sun gear assembly 41 rotates clockwise, and the swing gear 49 as it rotates about its own axis in mesh with the medium-diameter gear **41*b* of the sun gear assembly 41 revolves away from the idle gear 47, angularly moving the swing arm 48 clockwise. A pin 53 projecting from the swing arm 48 the engages in a groove 55 defined in the support plate 45 or another link plate 54, preventing the swing arm 48** from swinging further.

Figure 8:
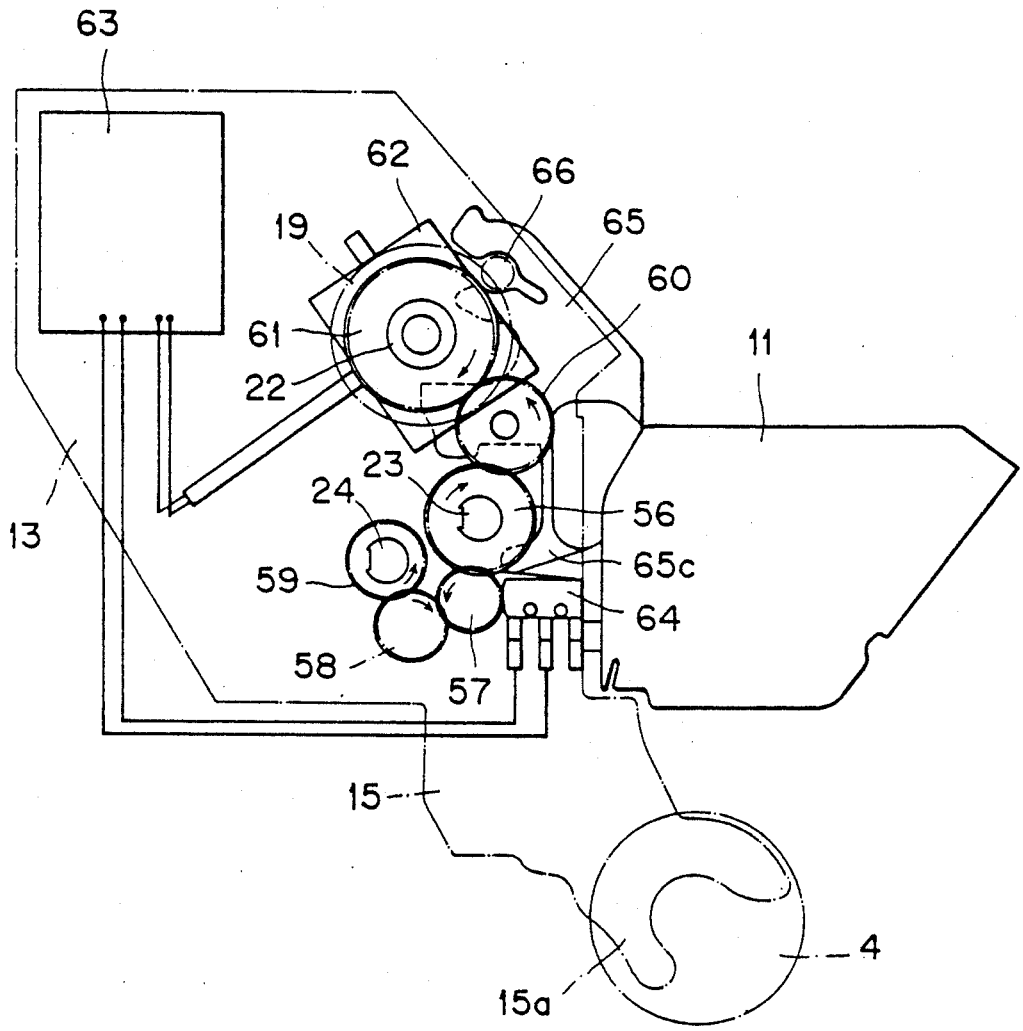
FIG. 8 is a side elevational view showing a second gear transmission mechanism.
Figure 9:
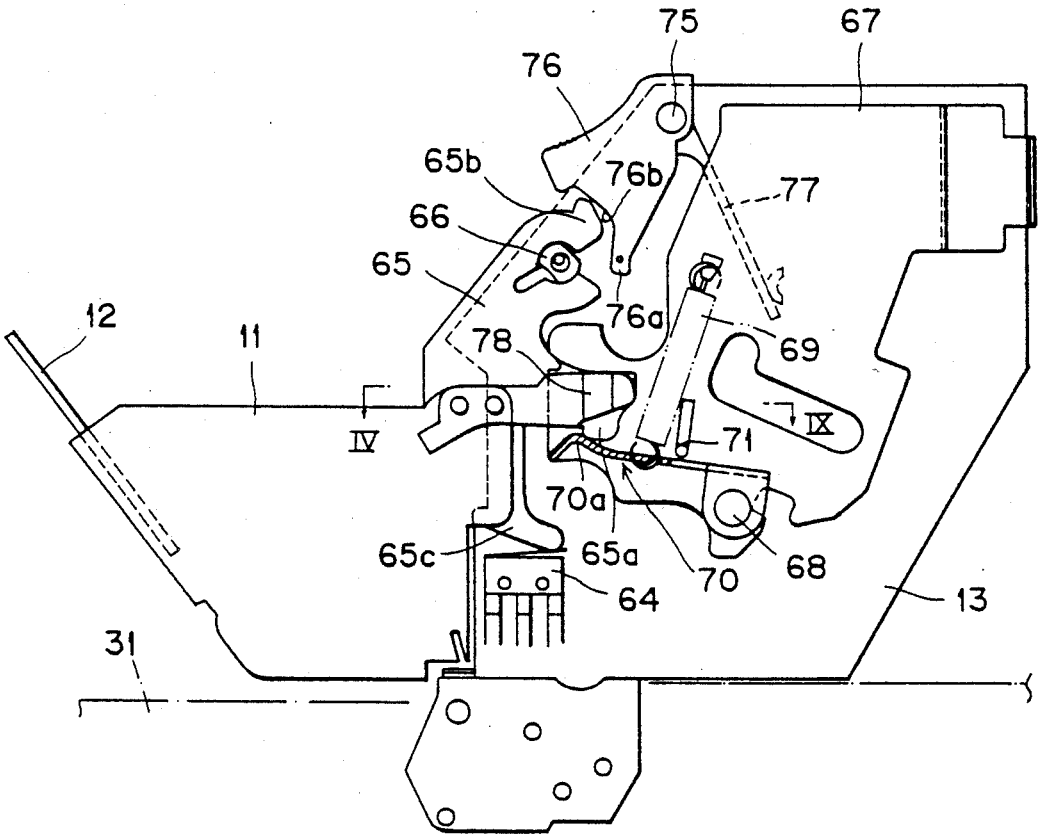
FIG. 9 is a side elevational view showing a stacker in a lowermost position.
Figure 10:
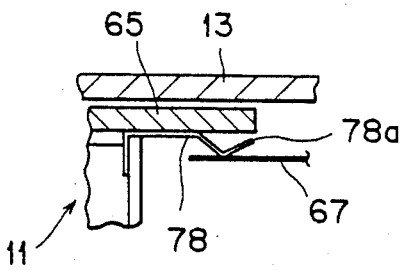
FIG. 10 is a cross-sectional view taken along line IX—IX of FIG. 9, showing a connector for removing electrostatic charges.

As shown in FIG. 8, the second gear transmission mechanism 26 on the side of the left side frame 13 has a left intermediate roller gear 56 fixedly mounted on the shaft 23. Rotative power from the intermediate roller gear 56 is transmitted through a group of transmission gears 57, 58 to a left intermediate roller gear 59 on the shaft 24 on which the intermediate roller 21 is mounted. The second gear mechanism 26 also has an idle gear 60 held in mesh with the left intermediate roller gear 56 and also with a sheet feed gear 61 fixedly mounted on the shaft 22 of the sheet feed rollers 19. Therefore, the rotative power from the left intermediate roller gear 56 is also transmitted to the idle gear 60 to rotate the sheet feed rollers 19 in the direction to feed a sheet P as indicated by the solid-line arrow in FIG. 8. The shaft 22 is selectively rotated and stopped by an electromagnetic clutch 62 interposed between the sheet feed gear 61 and the shaft 22, the electromagnetic clutch 62 being selectively engageable and disengageable by a signal from the control unit 63.

A microswitch 64 is disposed inside of the side frame 13. When a presser **65*c* projecting from one stacker stay 65 as it is in a lowermost position pushes the microswitch 64, the control unit 63 of the printer is set to an automatic sheet feeding mode which is carried out by the automatic sheet feeder 8. When the automatic sheet feeding mode (corresponding to the first mode) is initiated, the electromagnetic clutch 62 is engaged, allowing the sheet feed rollers 19 to rotate. When the stacker 10 is lifted into an intermediate position, the presser 65*c* disengages from the microswitch 64, and the control unit 63 switches to a continuous-form sheet printing mode or a manual sheet inserting mode (both corresponding to the second mode). At this time, the electromagnetic clutch 62 is disengaged, and no rotative power is transmitted to the sheet feed rollers 19. The continuous-form sheet printing mode and the manual sheet inserting mode are selected one at a time by a control switch on the printer 1**.

An electric circuit connected to the microswitch 64 is shown in FIG. 1. The microswitch 64 has one terminal connected to a positive terminal E of a power supply through a resistor R1, and other terminal grounded (i.e., connected to the negative terminal of the power supply. The positive terminal of the microswitch 64 is coupled to the input terminal of a NOT gate NOT1. The output terminal of the NOT gate NOT1 is connected to the base of a transistor Tr1 for energizing the electromagnetic clutch 62, through an input terminal of an AND gate AND3. The other input terminal of the AND gate AND3 is supplied with a control signal S2 from the printer 1. The transistor Tr1 has a collector connected to the positive terminal E of the power supply, and an emitter connected to a control coil 62L of the electromagnetic clutch 62. The output terminal of the AND gate AND3 is connected to one terminal of a resistor R2, whose other terminal is coupled to one terminal of a light-emitting diode D1. The other terminal of the light-emitting diode D1 is connected to ground. The light-emitting diode D1 emits light in the automatic sheet feeding mode. The control coil 62L is shunted by a diode D4 which drains an instantaneous current that is produced when the transistor Tr1 is turned off.

The positive terminal of the microswitch 64 is also connected to input terminals of AND gates AND1, AND2. A control signal S1 which is applied from the printer 1 depending on the status of a continuous-form sheet/manual sheet feeding switch on the printer 1 is applied to the AND gate AND2 and also to the AND gate AND1 through a NOT gate NOT2. The output terminals of the AND gates AND1, AND2 are connected to the respective bases of driver transistors Tr2, Tr3. The transistors Tr2, Tr3 have collectors connected to the positive terminal E of the power supply, and emitters connected to light-emitting diodes D2, D3, respectively, through respective resistors R3, R4. The light-emitting diodes D2, D3 emit light in the continuous-form sheet feeding mode and the manual sheet feeding mode, respectively.

A pair of stacker stays 65 projects rearwardly from the lateral opposite ends of the tray 11 of the stacker 10. The stacker stays 65 are detachably and angularly movably mounted on respective support shafts 66 on the side frames 13. The stacker 10 can be selectively brought by a position control means (described below) into a lowermost position which is positioned near the sheet discharge slot DI, an intermediate position which is higher than the lowermost position away from the sheet discharge slot DI, and an uppermost position in which the tray 11 of the stacker 10 is largely turned upwardly.

Figure 3:
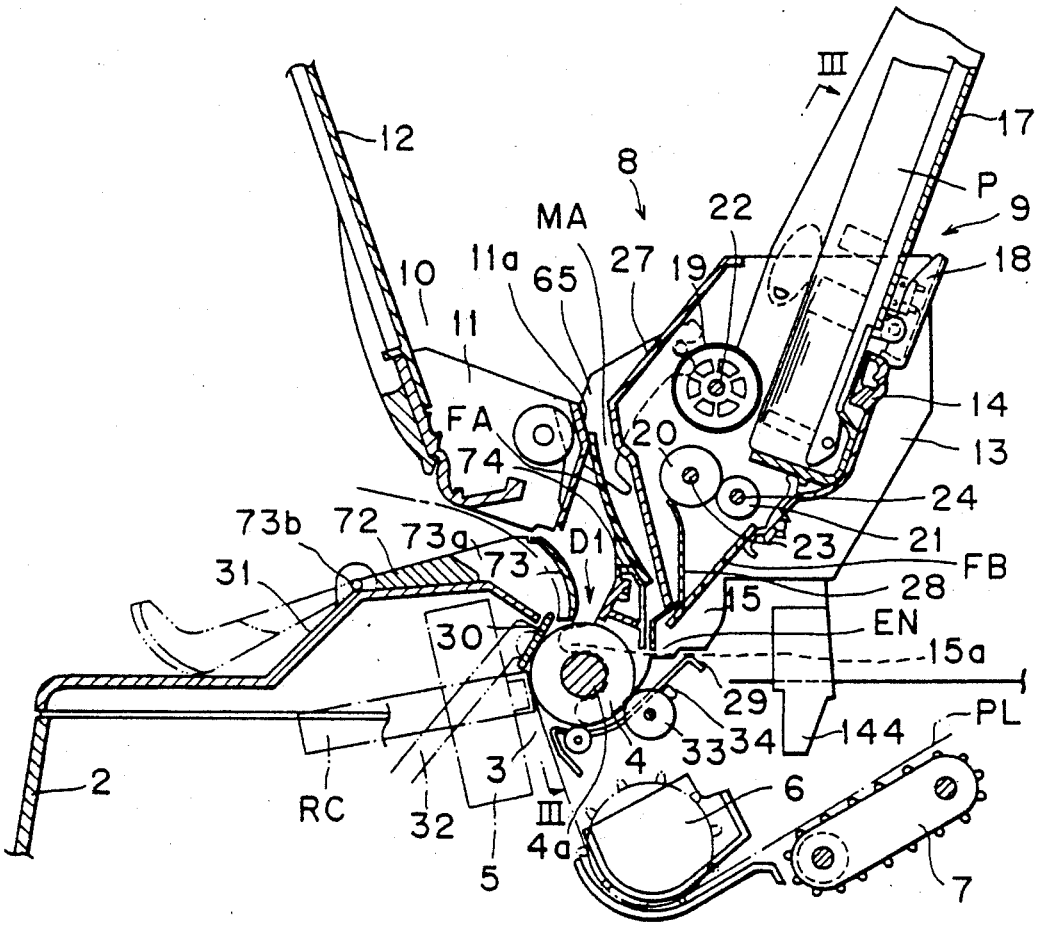
FIG. 3 is a cross-sectional view taken along line II—II of FIG. 2.
Figure 4:
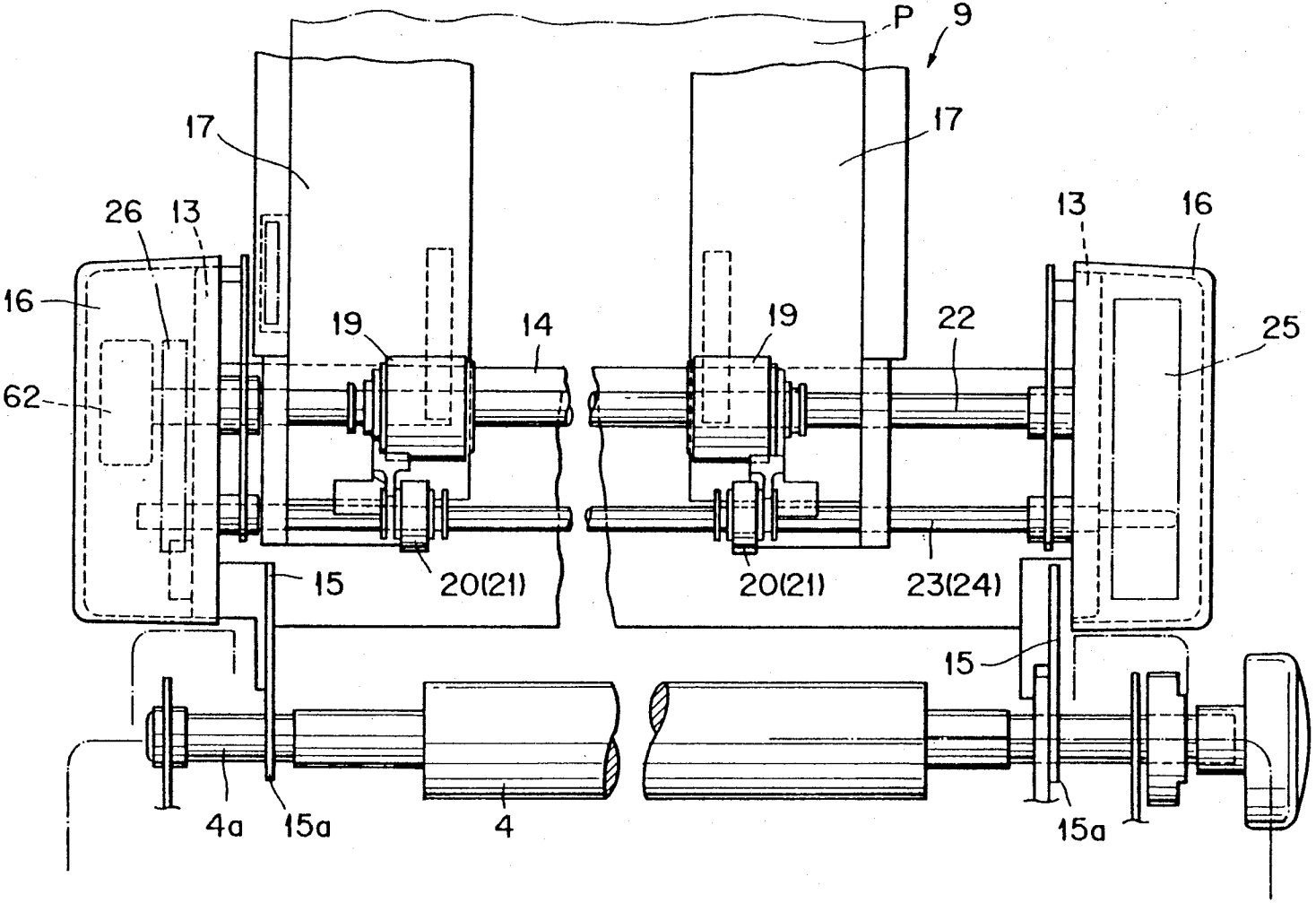
FIG. 4 is a plan view taken along line III—III of FIG. 3 particularly showing a hopper section.
Figure 17:
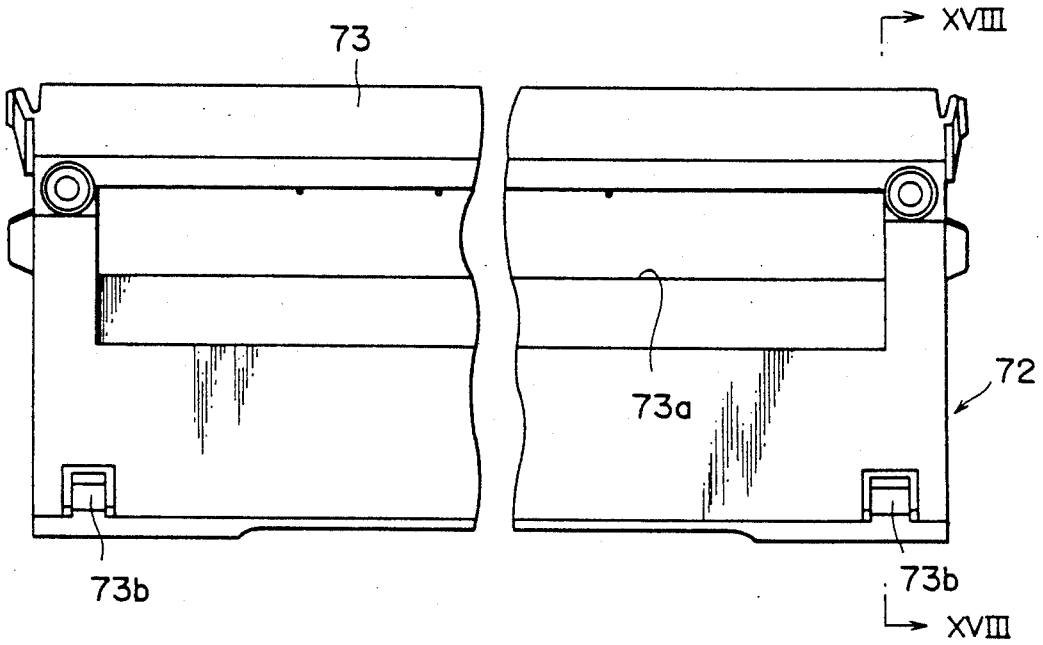
FIG. 17 is a plan view showing a continuous-form sheet guide member.
Figure 18:
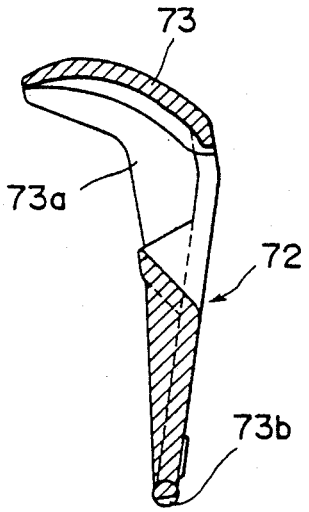
FIG. 18 is a cross-sectional view taken along a line XVIII—XVIII of FIG. 17.

A continuous-form sheet guide member 72 is provided for introducing the continuous-form sheet PL into a front portion of the printer by being positioned in confrontation with a rear portion of the cutter member 30 in the sheet discharge slot DI when the stacker 10 is retracted from the sheet discharge slot DI. As shown in FIGS. 3, 17 and 18, the continuous-form sheet guide member 72 has a base end pivotally provided with a pair of pivot shafts 73*b*, 73*b* for pivoting the guide member 72 frontwardly and rearwardly at a position above the front cover 31. On the other hand, a tip end portion (free end portion) of the guide member 72 is formed with a laterally elongated sheet output port 73*a* which allows the continuous-form sheet PL to pass therethrough. At a tip end side of the elongated sheet output port 73*a*, an elongate guide portion 73 having an arcuate cross-section is provided which can be positioned rearwardly of the cutter member 30 and can introduce the continuous-form sheet PL to the front portion of the printer 1 through an inner surface of the arcuate guide portion when the continuous-form guide member 72 is pivotally tilted rearwardly so that it moves toward the sheet discharge slot DI.

A downwardly directed pawl member 144 is provided as shown in FIG. 3 for preventing the automatic sheet feeder from being pivotally tilted frontwardly due to the increase in weight of the cut sheets stacked onto the stacker 10. The pawl member 144 is engageable with and disengageable from edges of right and left upper plates positioned rearwardly of the frame 2 of the printer 1.

The position control means will next be described below. An inner plate 67 is fixed in spaced relation to an inner side of one of the side frames 13. A rocker arm 70 has an end pivotally supported on the inner plate 77 by a pivot pin 68, and is normally urged to turn upwardly by a spring 69, the rocker arm 70 having a distal end 70*a*. When the distal end 70*a* of the rocker arm 70 engages an engaging portion 65*a* of the stacker stay 65, the tray 11 of the stacker 10 is held in the lowermost position near the upper surface of the front cover 31 (see FIG. 9). The upward angular displacement of the rocker arm 70 is limited by a stopper 71.

Figure 11:
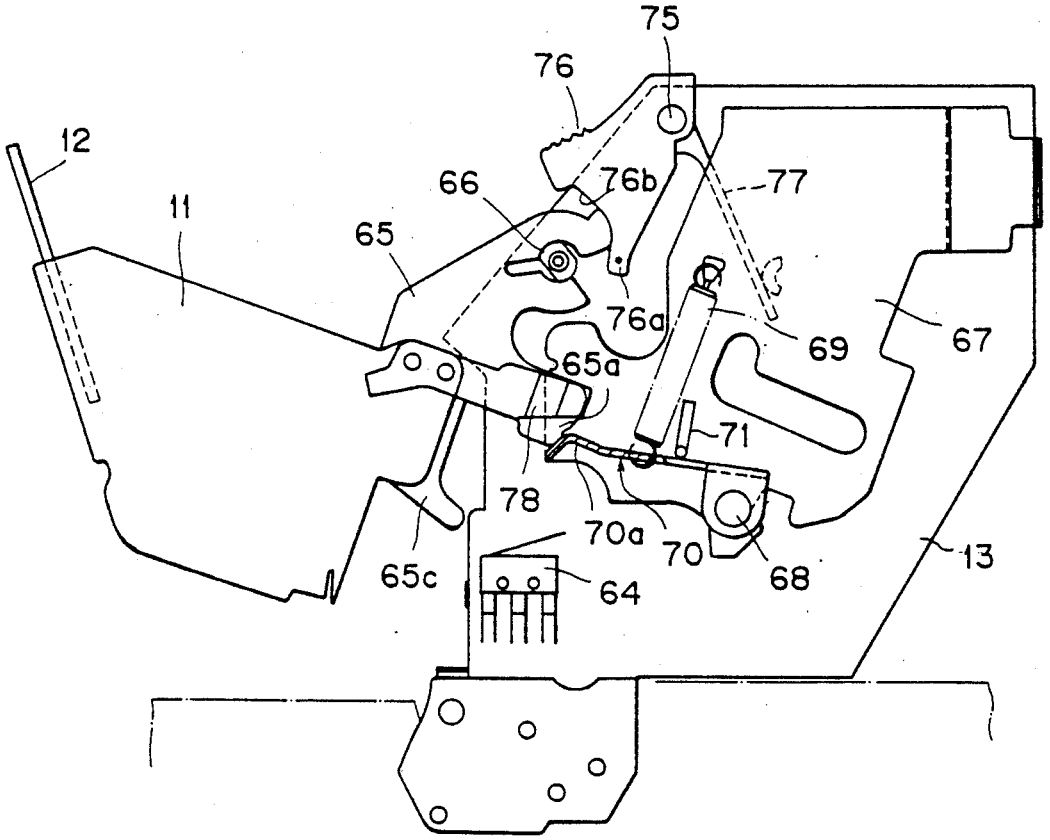
FIG. 11 is a side elevational view showing the stacker in an intermediate position.
Figure 16:
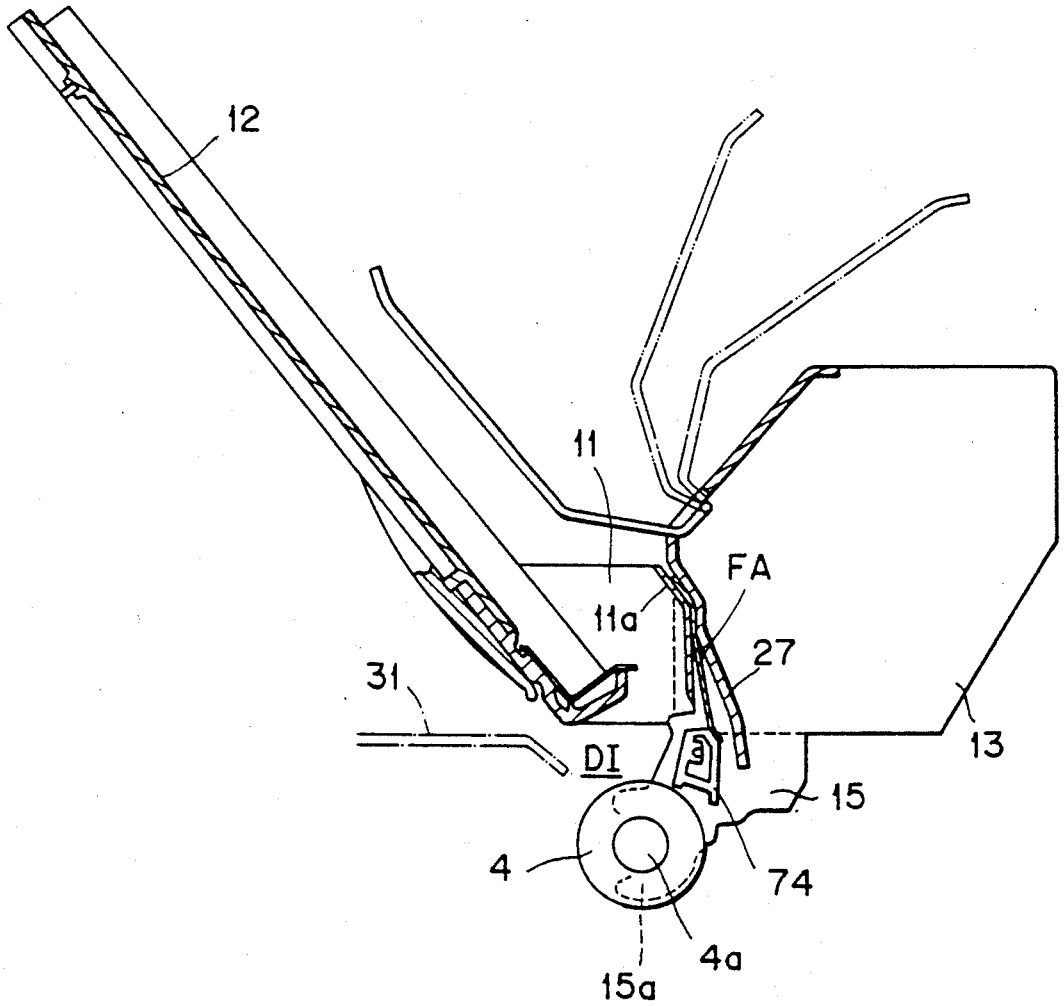
FIG. 16 is a sectional side elevational view showing the stacker in the lowermost position.

When the stacker tray 11 is manually turned upwardly until the rear end of the engaging portion 65*a* of the stacker stay 65 is angularly pushed clockwise (FIG. 11) about the support shaft 66 by the rocker arm 70, the tray 11 is held in the vertically intermediate position as shown in FIGS. 3 and 11, and is retracted from the sheet discharge slot DI. In this position, a continuous-from sheet PL fed by the pin roller 6 and the pin tractor 7 and printed against the platen 4 passes through a sheet outlet 73 of a continuous-form sheet guide 70 while being pressed against the front surface of the platen 4 by the cutter 30, to a position in front of the printer. At the same time, a manual sheet insertion slot MA is defined between the front wall plate 27 and a rear plate 11*a* of the tray 11, for allowing a single sheet to be manually inserted therethrough. To a manual sheet insertion guide 74, there is bonded a flexible film FA having an upper end held in contact with the rear plate 11*a* at an acute angle of about 40 degrees. The film FA should be of a suitably flexible material, which is polyester in this embodiment. When a continuous-form sheet is used, the continuous-form sheet as it is printed passes between the film FA and the rear plate 11*a* while flexing the film FA. When a single sheet is manually inserted, it passes between the front surface of a lower portion of the front wall plate 27 and the manual sheet insertion guide 74 toward a rear surface of the platen 4, and is printed against the platen 4. When the stacker is in the lowermost position, the flexible film FA is flexed at its distal and proximal ends as shown in FIG. 16. Therefore, the stacker can quickly and easily be displaced into the lowermost position, without being obstructed by the film FA.

Figure 12:
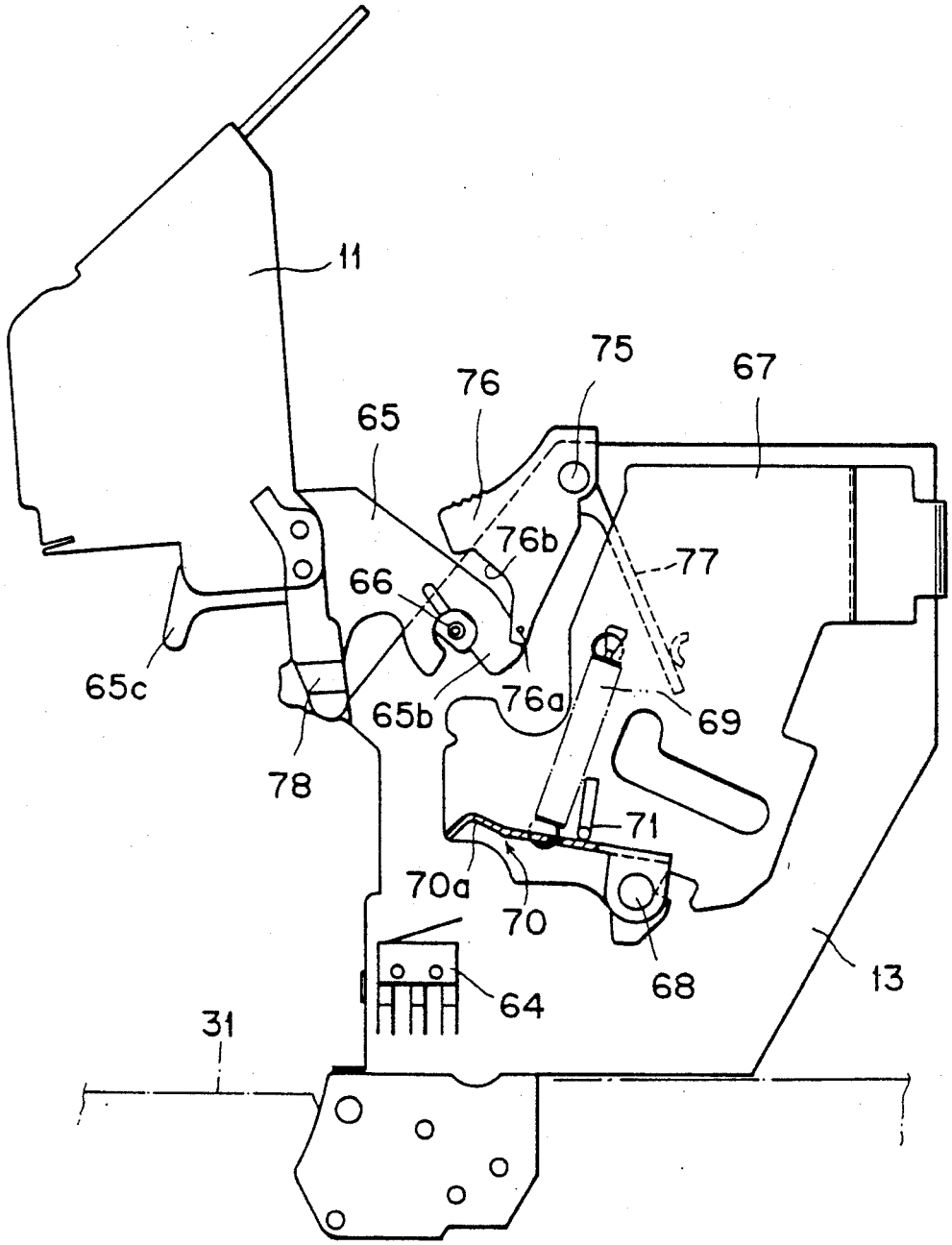
FIG. 12 is a side elevational view showing the stacker in an uppermost position.
Figure 13:
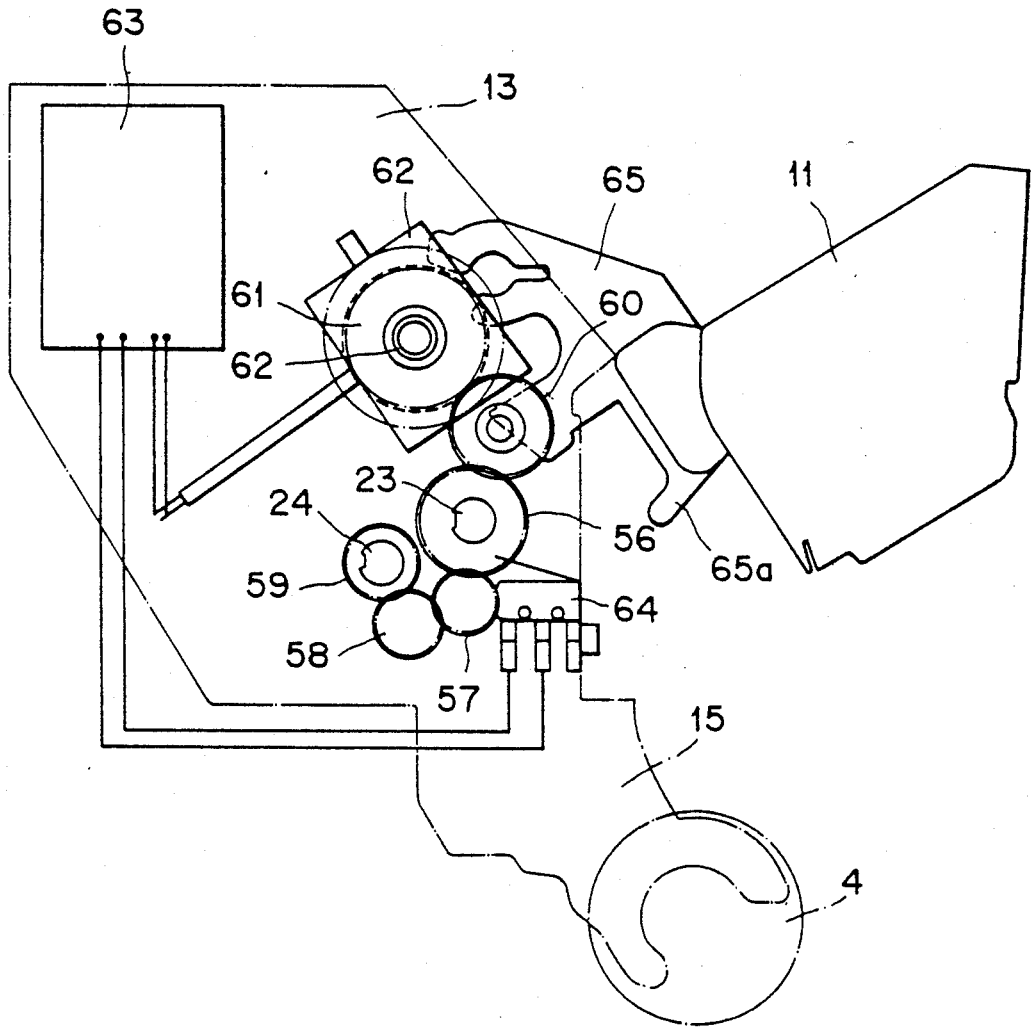
FIG. 13 is a side elevational view showing the second gear transmission mechanism with the stacker in the intermediate position.

As shown in FIG. 12, a lock lever 76 is pivotally supported on an inner side of one of the side frames 13 by a pivot shaft 75, and a rod shaped spring 77 projects from the rocker lever 76. In the embodiment, the spring 77 is integrally formed with the rock lever 76. However, the spring 77 and the lock lever 76 may separate from each other. The spring 77 has a distal end engaging the inner plate 67. When an engaging portion 76*a* of the lock lever 76 engages in a recessed engaging portion 65*b* of the distal end of the stacker stay 65 of the stacker 10 which is largely turned upwardly, since the engaging portion 76*a* is biased upwardly under the bias of the spring 77, the tray 11 of the stacker 10 is held in the uppermost position in which it is largely turned upwardly. In the uppermost position, the front cover 31 can freely be opened and closed without interference with the tray 11, for easy replacement of the ribbon cassette RC.

When the lock lever 76 is pushed downwardly to disengage the engaging portion 76*a* thereof from the recessed engaging portion 65*b* at the distal end of the stacker stay 65, the distal end of the stacker stay 65 slides against a concave surface 76*b* of the lock lever 76 which is urged to turn forwardly under the bias of the spring 77. The tray 11 now descends at a reduced speed to the intermediate position by gravity. Incidentally, the position control means may be arranged to hold a swing lever attached to the stacker stay at different angular positions.

A connector 78 in the form of a metal spring plate serves to remove electrostatic charges from the tray 11 of the stacker 10. The connector 78 has one end held in sliding contact with a metal component in the tray 11. The other end 78*a*, which is angularly bent, of the connector 78 extends rearwardly along an inner surface of the stacker stay 65. When the tray 11 is in the lowermost position (see FIG. 9) or the intermediate position (see FIG. 11), the connector end 78*a* is held in sliding contact with a side of the inner plate 67, which is made of metal, thereby draining electrostatic charges to the ground of the printer.

Figure 14:
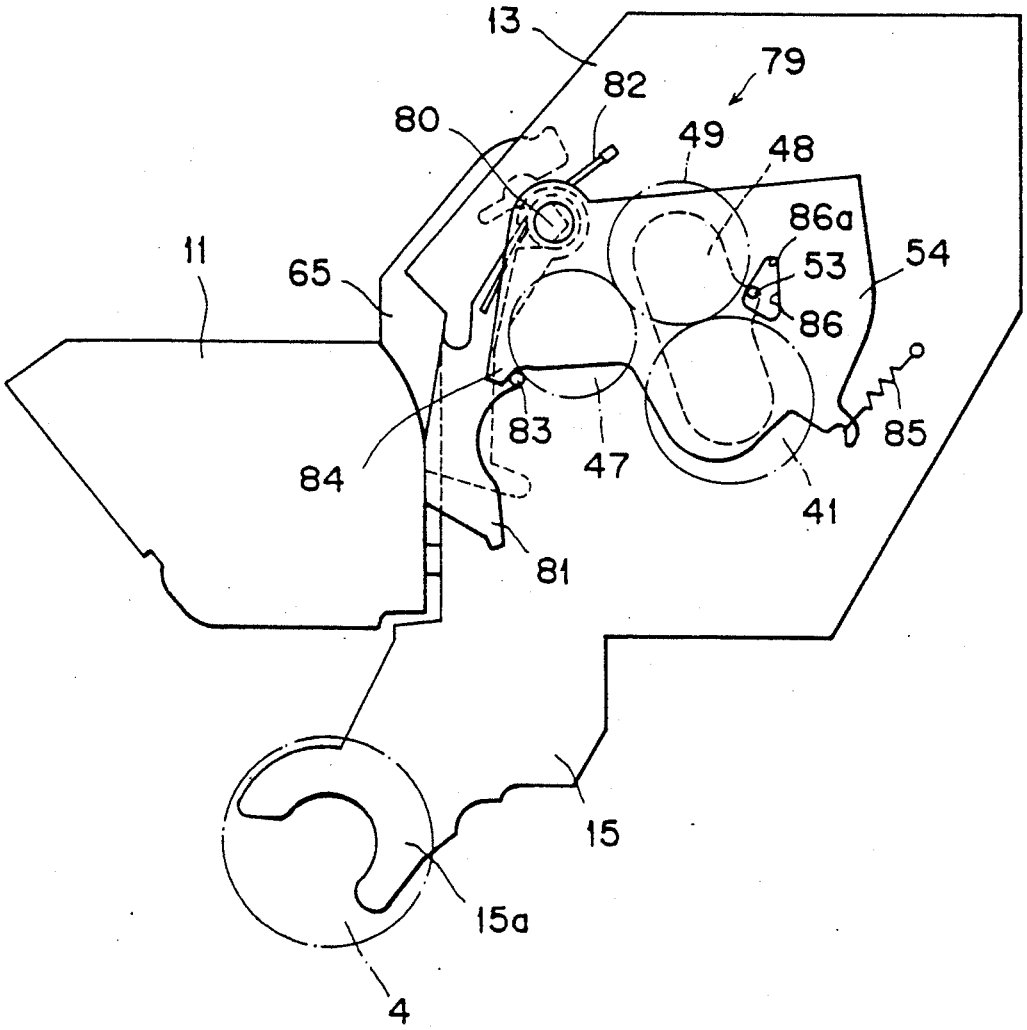
FIG. 14 is a side elevational view showing an interlink mechanism with the stacker in the lowermost position.
Figure 15:
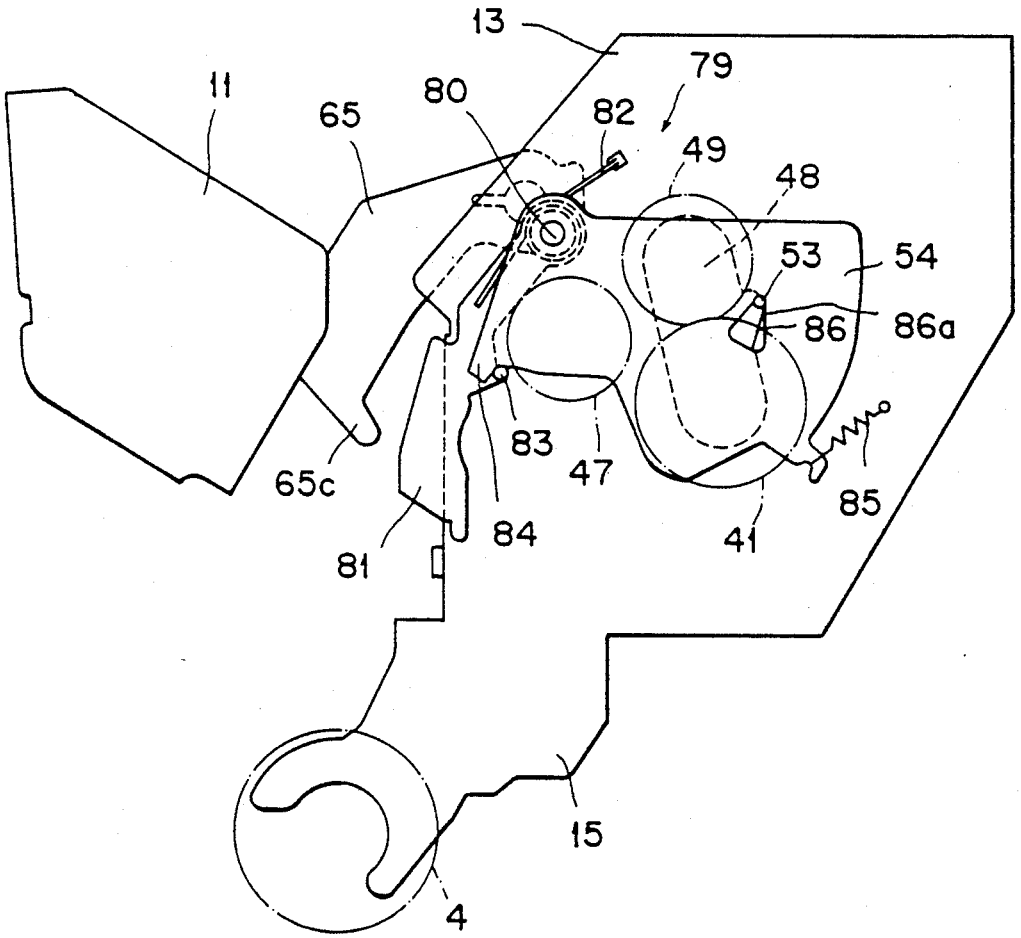
FIG. 15 is a side elevational view showing the interlink mechanism with the stacker in the intermediate position.

As shown in FIGS. 14 and 15, an interlink mechanism 79 limits the angular displacement of the swing arm 48 in order to selectively transmit the rotative power to the intermediate roller 21 of the first gear transmission mechanism 25. The interlink mechanism 79 comprises a link plate 54 angularly movably supported on the support plate 45 or the side frame 13 by a shaft 80, and a push lever 81 interposed between the link plate 54 and the stacker 10. The push lever 81 is held against the back of the stacker tray 11, and turns the tracker tray 11 upwardly under the bias of a spring 82 such as a torsion spring. An engaging pin 83 mounted on the push lever 81 engages an engaging portion 84 of the link plate 54. The link plate 54 is normally urged to turn backwards by a tension spring 85. With the tray 11 spaced from the push lever 81, the biasing force of the spring 82 which tends to turn the link plate 54 forwardly through the engaging pin 83 on the push lever 81 is selected to be greater than the biasing force of the tension spring 85 which tends to pull the link plate 54 backwards.

The link plate 54 has a sector-shaped limiting groove 86 (wider at its end near the swing arm 48 and narrower at the other end) defined therein, and the engaging pin 53 projecting from the swing arm 48 engages in the groove 86. When the tray 11 is turned upwardly away from the push lever 81, a lower portion of the link plate 54 is turned forwardly, and an edge of the limiting groove 86 in the link plate 54 pushes the engaging pin 53 rearwardly. The swing gear 49 on the swing arm 48 is shifted out of mesh with the idle gear 47 (see FIG. 15), preventing the rotative power from being transmitted to the intermediate roller 20. The engaging pin 53 is wedged into a narrower notch 86*a* of the limiting groove 86, so that the swing arm 48 is prevented from turning freely.

Conversely, when the stacker tray 11 pushes the push lever 18 rearwardly, the lower portion of the link plate 54 is turned rearwardly, positioning the engaging pin 53 in the wider end of the limiting groove 86. The swing arm 48 is now angularly movable between a position in which the swing gear 49 meshes with the idle gear 47 and a position in which the swing gear 49 is held out of mesh with the idle gear 47.

Operation of the automatic sheet feeder thus constructed will be described below.

To print separate sheets P, they are stacked in the hopper 9 of the automatic feeder 8, and a continuous-form sheet guide 72 is angularly moved into a position in front of the front cover 31 as indicated by the two-dot-and-dash lines in FIG. 3, after which the tray 11 of the stacker 10 is held in a position near the upper surface of the front cover 31. The control signal S2 from the printer is now applied to render the transistor Tr1 conductive, engaging the electromagnetic clutch 62 and energizing the light-emitting diode D1, which indicates the automatic sheet feeding mode. When a printing mode is selected, the sheets P are fed, one by one, to the platen 4 by the sheet feed rollers 19 and the intermediate rollers 20, 21.

At this time, the step motor, serving as a sheet feed motor, is started, and the rotational speed thereof is increased at a slow rate to a predetermined speed (e.g., 600 PPS). Once the predetermined speed is reached, the step motor rotates at a constant speed. The platen gear 36 and the platen 4 are rotated normally (clockwise in FIG. 5), and the intermediate rollers 20, 21 are rotated normally (in the direction to feed the sheets). Simultaneously, the electromagnetic clutch 62 is engaged to rotate the sheet feed rollers 19 to feed the sheets P from the hopper 9 to the platen 4.

When the leading end of a sheet P reaches the photosensor 34, it is detected, and the step motor is controlled to reduce its rotational speed. While the step motor is decelerating, it is rotated through a certain number of steps or angular displacements, after which the step motor is stopped. At this time, the electromagnetic clutch 62 is disengaged when the AND gate AND3 is closed by the control signal S2 in FIG. 1. The sheet feed rollers 19 no longer rotate even if the intermediate rollers 20, 21 rotate.

Figure 7:
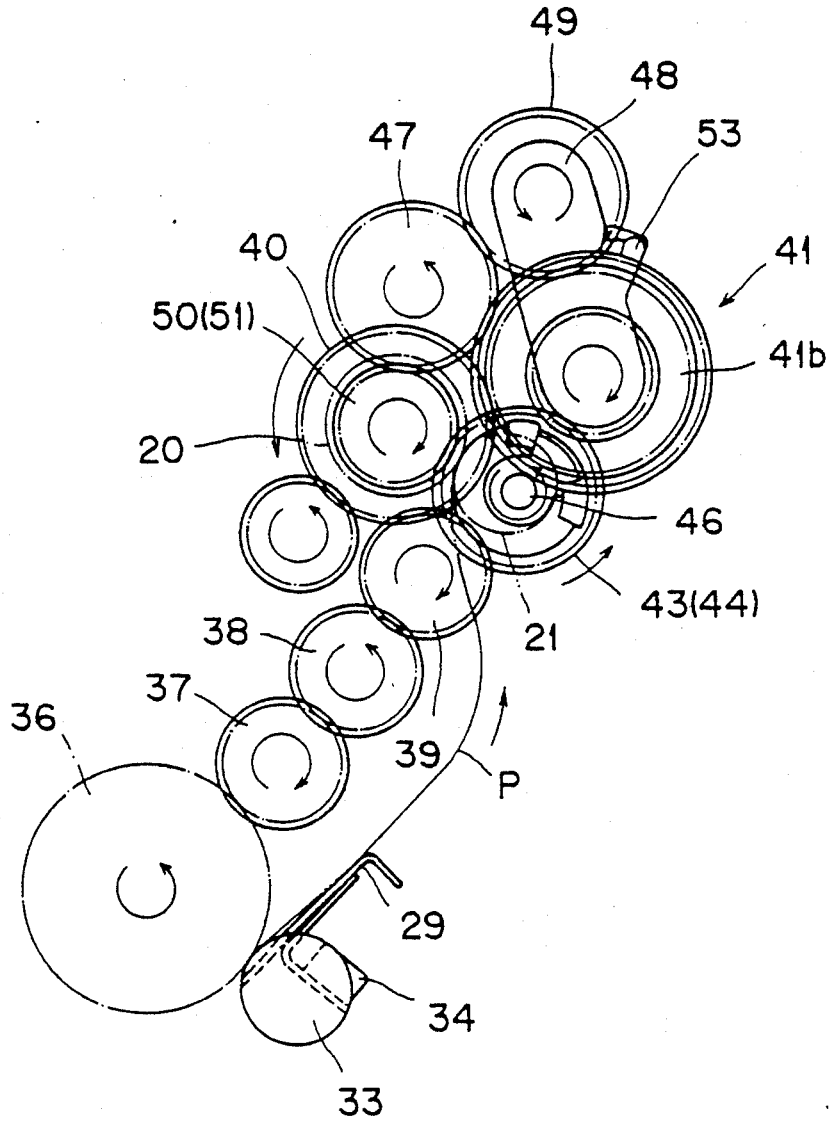
FIG. 7 is a view illustrative of the manner in which a sheet flexes.

Thereafter, the step motor is reversed, and rotated through a given number of steps or angular increments. In this condition, as shown in FIG. 7, the platen gear 36 (the platen 4) is reversed (i.e., rotated counterclockwise), and the sun gear assembly 41 is rotated clockwise through the transmission gears 37, 38, 39 and the intermediate idle gear 40 of the first gear transmission mechanism 25. Thus, the swing gear 49 meshing with the medium-diameter gear 41*b* of the sun gear assembly 41 rotates about its own axis, while at the same time revolving clockwise away from the idle gear 47.

The transmission gear 51 is rotated clockwise through the main and auxiliary idle gears 43, 44 that mesh with the smaller-diameter gear 41*c* of the sun gear assembly 41. At this time, the one-way clutch 52 combined with the transmission gear 51 is locked to rotate the shaft 23. The intermediate rollers 20 are rotated normally to feed the sheet P gripped between the intermediate rollers 20, 21 to the platen 4. The sheet P is now caused to flex in its intermediate area between the intermediate rollers 20, 21 which rotate normally and the platen 4 and the pinch roller 33 which are reversed. The flexible film FB does not prevent the sheet P from flexing because the flexible film FB is pushed and curved by the flexing portion of the sheet P. Under the resiliency of the sheet P due to its flexing state, the leading end of the sheet P is pushed against the abutting region of the platen 4 and the pinch roller 3 parallel to the axis of the platen 4, at a certain angle of contact (see FIG. 7). After the platen gear 33 is reversed through a predetermined number of steps or angular displacements, the platen gear 33 is stopped for a short period of time, and then rotated again normally.

The normal rotation of the plate gear 33 causes the transmission gears 37, 38, 39 and the intermediate idle gear 40 to rotate the sun gear assembly 41 counterclockwise. Consequently, the swing gear 49 meshing with the medium-diameter gear 41*b* revolves counterclockwise (and the swing gear 48 rotates counterclockwise) while rotating about its own axis, and is brought into mesh with the idle gear 47, rotating the intermediate roller gear 50 clockwise. The shaft 23 on which the intermediate roller gear 50 is fixedly mounted, and hence the intermediate rollers 20, 21 rotate normally to feed the sheet P.

The timing of switching from the normal rotation to the reverse rotation and then to the normal rotation can therefore be rendered fixed irrespective of the magnitude of a force (i.e., the magnitude of rigidity of the sheets P) tending to reverse the intermediate rollers 20, 21 under the resiliency of the flexing portion of the sheet P. The switching timing is established in view of backlashes between the gears of the first gear transmission mechanism 25, for thereby stabilizing the timing of introducing the sheets P into the printer 1.

Between the sun gear assembly 41 and the transmission gear 51, there are disposed the two gears, i.e., the main idle gear 43 and the auxiliary idle gear 44, which are interconnected so that they are idly angularly movable relatively to each other, thereby preventing the flexing of sheets P from being accumulated and getting larger due to a repetition of the normal and reverse rotation.

To print a single sheet P, the swing arm 48 has to be able to move toward and away from the idle gear 47. When the stacker tray 11 is held in the lowermost position, the push lever 81 is pushed backwards, and the link plate 54 is kept turned backwards under the force of the tension spring 58. The engaging pin 53 on the swing arm 48 is positioned in the wider end of the limiting groove 86 in the link plate 54, allowing the swing arm 48 to swing between the position in which the swing gear 49 is held in mesh with the idle gear 47 and the position in which the swing gear 49 is brought out of mesh with the idle gear 47.

Thus, the cut sheet P fed toward the platen 4 and printed by the print head 5 is discharged from the sheet discharge slot DI in such a manner that the sheet is entered into the lower portion of the tray 11 of the stacker 10, and is directed to the upper portion of the tray 11. The cut sheets are successively stacked on the sheet support arm 12 with the printing surfaces facing downwardly.

When the continuous-form sheet PL is to be printed, a continuous-form sheet/single sheet selector switch on the printer is operated on to select a continuous-form sheet printing mode, and the stacker 10 is turned upwardly and held in the intermediate position. A longitudinal guide portion at the free end of the continuous-form sheet guide 72 is brought behind the cutter 30 at the sheet discharge slot DI. The presser 65*c* disengages from the microswitch 64, rendering the transistor Tr1 nonconductive. Therefore, the electromagnetic clutch 62 is disengaged, and the light-emitting diode D1 for indicating the automatic sheet feeding mode is de-energized. At this time, counterelectromotive forces are generated across the control coil 62L of the electromagnetic clutch 62, but are drained through the diode D4 nd the resistor connected thereto. A control signal S1 is applied from the printer 1, making both input terminals of the AND gate AND2 high, so that the light-emitting diode D2 is energized, indicating the continuous-form sheet printing mode.

The continuous-form sheet PL fed to the platen 4 by the pin tractor 7 and the pin roller 6 is printed by the print head 5. Thereafter, the continuous-form sheet PL that has passed between the front surface of the platen 4 and the cutter 30 is directed upwardly in the sheet outlet 73 of the continuous-form sheet guide 72. The continuous-form sheet PL is then guided by an inner surface of the longitudinal guide portion, which is curved forwardly, of the continuous-form sheet guide 72 to a front portion of the upper surface of the front cover 31. At this time, the path of the continuous-form sheet PL is blocked by the flexible film FA. However, with the flexibility of the flexible film FA being suitably selected, the continuous-form sheet PL flexes the film FA, and passes between the film FA and the rear plate 11*a*.

Incidentally, the cutter member 30 is stationarily positioned in the vicinity of the front position of the platen 4. Therefore, the continuous-form sheet PL can be cut in the transverse direction thereof by strongly and slantingly pulling the sheet frontwardly, since the sheet is brought into engagement with the upper edge (acute edge) of the cutter member 30.

In the intermediate position, the biasing force of the spring 82 applied to the push lever 81 is stronger than the biasing force of the spring 85, turning the lower portion of the link plate 54 forwardly. The swing arm 48 is turned backwards through the limiting groove 86, and the swing gear 49 on the swing arm 48 is brought out of mesh with the idle gear 47, cutting off the transmission of rotative power to the intermediate rollers 20. The sheet feed mechanism of the automatic sheet feeder 8 is therefore prevented from being unnecessarily actuated, and the intermediate rollers 20, 21 and the sheet feed roller 19 are prevented from being unnecessarily worn.

When a manually inserted sheet is to be printed, the power transmission mechanism of the automatic sheet feeder according to the present invention operates in the same manner as when the continuous-form sheet is printed. A sheet is manually inserted through the manual sheet insertion slot MA. At this time, the sheet is guided along the flexible film FA into the sheet insertion slot of the printer, and hence is not inserted into a gap which is created when the stacker 10 is moved. Since no control signal S1 is applied from the printer, the NOT gate NOT2 applies a signal of high level to the AND gate AND1. Therefore, both input terminals of the AND gate AND1 go high, and hence the output terminal thereof also goes high. The diode D3 is energized, indicating the manual sheet inserting mode.

The present invention is not limited to the above embodiment, but may be changed or modified in various ways. For example, in order to make the film FA highly flexible and highly durable, the film FA may be of an increased thickness and ma have cutouts or the like. The cutouts should preferably be defined as sharp cutouts along the direction in which a manually inserted sheet and a continuous-form sheet travel, so as not to obstruct the travel of these sheets. Further, the present invention is also available for a printer having no mechanism for supplying the continuous-form sheet.

As described above, according to the present invention, when a single sheet is manually inserted, it does not enter a gap which is created when the stacker is moved to the retracted position, and hence is reliably fed into the printer. The automatic sheet feeder according to the present invention is additionally advantageous in that any increase in the number of components used and any increase in the number of manufacturing steps therefor are small as compared with conventional automatic sheet feeders.

Further, according to the present invention when the continuous-form sheet is to be printed, while the frontwardly extending stacker of the automatic sheet feeder is retracted from the sheet discharge slot, the continuous-form sheet guide member is positioned rearwardly of the cutter member for cutting the continuous-form sheet after its printing. Accordingly, the continuous-form sheet can be introduced to a front position of the printer without any interference with the stacker, and the continuous-form sheet can be easily cut with a predetermined length. Therefore, according to the present invention, the printing to the continuous-form sheet and the cut sheets can be easily selectively achieved without any detachment of the automatic sheet feeder/discharger device from the printer, to thereby obtain improved printing efficiency.

Furthermore, according to the present invention, the stacker is upwardly and downwardly pivotally mounted with respect to the side frame of the automatic sheet feeder, and when the position of the stacker is held at its lower position by the position control means, drive force is transmitted to the sheet feed mechanism of the hopper through the interlink mechanism associated with the gear transmission mechanism. Reversely, if the position of the stacker is held at its upper position, the power transmission to the sheet feed mechanism is shut-off. Therefore, inadvertent operation of the automatic sheet feeder at the time of printing to the continuous-form sheet in the printer can be avoided. Accordingly, in the present invention, switching between the printing to the cut sheets and printing to the continuous -form sheet can be easily carried out by simply changing the pivotal position of the stacker, and easy handling to these sheets results.

Further, more, in the depicted embodiment, after the normal rotation of the platen and the intermediate roller pair for feeding the cut sheet, the platen is reversely rotated while the intermediate roller pair are rotated in the normal direction so as to generate the sheet slack or flexed portion. Thereafter, the platen and the intermediate roller pair are again rotated in the normal direction. Such switching with respect to the rotation of these rollers and platen is carried out by the gear transmission mechanism bridging between the platen and the intermediate roller pair, and particularly by the swing gear 49 supported on the swing arm 48 and the transmission gear 51 provided with the one-way clutch 52. The swing gear 49 swingable in response to the rotational direction of the platen causes the intermediate roller pair to rotate in the normal direction during normal rotation of the platen through the idle gear 47, and the swing gear 49 is disengaged from the idle gear during reversal rotation of the platen. On the other hand, the one-way clutch of the transmission gear 51 is idly rotated during the normal rotation of the platen, and provides coupling during reverse rotation of the platen. Therefore, the operation of the swing gear and the transmission gear with the one-way clutch do not interfere with each other. Therefore, even during the switching timing from the reverse to normal rotation of the platen, no reverse rotation occurs in the intermediate roller pair, but the intermediate roller pair can surely be rotated in the normal direction. Accordingly, the cut sheet can be introduced to the print head with a sufficient feeding amount, to thereby provide an intended top marginal space, and high quality printing.

While the invention has been described in detail and with reference to specific embodiment thereof, it would be apparent to those skilled in the art that various changes and modification maybe made therein without departing from the spirit and scope of the invention.

What is claimed is:

1. An automatic sheet feeder for use in a printer which includes a drive source, a sheet insertion section, a printing section, a sheet feed means for feeding a continuous-form sheet and a sheet discharge section, the sheet feeder including a hopper in which a stack of cut sheets are stored, and a stacker for storing printed cut sheets thereon, the automatic sheet feeder having a first sheet feed mode for supplying the cut sheet formed in the hopper to the sheet insertion section and a second sheet feed mode for supplying a sheet other than the sheet in the hopper, the automatic sheet feeder comprising:

the stacker provided pivotably movable between an operative position where the stacker is positioned adjacent to the sheet discharge section of the printer for receiving in the stacker the printed cut sheet printed at the printing section and a spaced position away from the sheet discharge section;

detecting means for detecting the operative position of the stacker, the detecting means providing a first signal indicative of the operative position of the stacker and a second signal indicative of the position of the stacker other than the operative position; and means for providing the second sheet feed mode when the stacker is out of the operative position in response to the second detection signal from the detecting means.

2. The automatic sheet feeder as claimed in claim 1, further comprising:

a sheet feed mechanism positioned beside the hopper for feeding the cut sheets held in the hopper one by one to the printing section of the printer; and a gear transmission mechanism for driving the sheet feed mechanism by the drive source of the printer.

3. The automatic sheet feeder as claimed in claim 2, wherein the printing section of the printer includes a platen, and wherein the gear transmission mechanism is connected between the platen and the sheet feed mechanism, the drive source of the printer being connected to the platen.

4. The automatic sheet feeder as claimed in claim 3 further comprising:

a side frame for supporting the hopper; and position control mechanism supported on said side frame for regulating pivotal position of the stacker.

5. The automatic sheet feeder as claimed in claim 4, wherein the means for providing the second sheet feed mode comprises an interlink mechanism for achieving ON/OFF control with respect to a power transmission to the sheet feed mechanism through the gear transmission mechanism in accordance with a movement of the position control mechanism.

6. The automatic sheet feeder as claimed in claim 5, wherein the position control mechanism comprises:

a rocker arm having one end pivotally supported to the side frame and having a free end biased in one direction;

a lock lever pivotally supported to the side frame and biased in a direction; and a stacker stay detachably and pivotally supported to the side frame, the stacker stay having a depression portion (65*c*), a first engaging portion (65*a*) engageable with the free end of the rocker arm for maintaining a lowermost operative position of the stacker, a second engaging portion engageable with the free end of the rocker arm for maintaining an intermediate pivot position of the stacker away from the sheet discharge section and a third engaging portion (65*b*) engageable with the lock lever for providing an uppermost pivotal position of the stacker far away from the sheet discharge section.

7. The automatic sheet feeder as claimed in claim 6, wherein the detecting means comprises a microswitch provided on the side frame, the microswitch being depressed by the depression portion when the stacker has the lowermost operative position to provide the first detection signal.

8. The automatic sheet feeder as claimed in claim 7, wherein the sheet feed mechanism comprises a sheet feed roller and intermediate roller pair positioned between the sheet feed roller and the platen; and wherein the means for providing the second sheet feed mode further comprises a clutch means operatively connected to the sheet feed roller for rotating the sheet feed roller in response to the first detection signal from the microswitch and for preventing the sheet feed roller from its rotation in response to the second detection signal from the microswitch.

9. The automatic sheet feeder as claimed in claim 8, wherein the gear transmission mechanism comprises a first gear transmission mechanism comprising:

a platen gear connected to the platen and driven by the power source;

an intermediate roller idle gear connected to one of the intermediate roller pair and driven by the platen gear;

a sun gear having first gear portion with which the intermediate roller idle gear is engaged in a planetary fashion, the sun gear also having second and third gear portions;

an idle main gear engageable with the second gear portion of the sun gear;

an idle sub gear movable together with the idle main gear and provided concentrical therewith;

a swing arm pivotally mounted on a shaft of the sun gear;

a swing gear engageable with the third gear portion of the sun gear and rotatably supported to the swing arm;

an intermediate roller gear fixed to a shaft of the intermediate roller; and a transmission gear mounted on the shaft of the intermediate roller, the transmission gear being provided with a one-way clutch for transmitting rotation to the shaft of the intermediate roller when the platen is reversely rotated, the one-way clutch being idly rotatable for preventing rotation of the shaft of the intermediate roller when the platen is rotated in a normal direction, the idle sub gear being engaged with the transmission gear.

10. The automatic sheet feeder as claimed in claim 9, wherein the gear transmission mechanism further comprises a second gear transmission mechanism comprising another intermediate roller gear connected to the shaft of the intermediate roller;

still another intermediate roller gear connected to the other intermediate roller and engageable with the another intermediate roller gear;

another idle gear engageable with the another intermediate roller gear;

a sheet feed roller gear connected to the sheet feed roller, the another idle gear being engageable with the sheet feed roller gear, the sheet feed roller being mounted on a sheet feed roller shaft.

11. The automatic sheet feeder as claimed in claim 10, wherein said clutch is provided between the sheet feed roller gear and the sheet feed roller shaft for selectively shutting off the rotation of the sheet feed roller.

12. The automatic sheet feeder as claimed in claim 1, wherein the printer further comprises cutter member provided at the sheet discharge section for cutting the continuous-form sheet; and guide means for guiding travel of the continuous-form sheet, the guide means being pivotally provided at a front portion of the printer and having a first pivot position at a position rearwardly of the cutter member for introducing the continuous-form sheet into the front portion of the printer when the stacker is moved to the spaced position and having a second pivot position spaced away from the sheet discharge section for allowing the stacker to be positioned to the operative position.

13. The automatic sheet feeder as claimed in claim 11, wherein the printer further comprises cutter member provided at the sheet discharge section for cutting the continuous-form sheet; and guide means for guiding travel of the continuous-form sheet, the guide means being pivotally provided at a front portion of the printer and having a first pivot position at a position rearwardly of the cutter member for introducing the continuous-form sheet into the front portion of the printer when the stacker is moved to the spaced position and having a second pivot position spaced away from the sheet discharge section for allowing the stacker to be positioned to the operative position.

14. The automatic sheet feeder as claimed in claim 2, wherein the printer includes a platen driven by the drive source, and wherein the sheet feed mechanism comprises a sheet feed roller for feeding the cut sheets stored in the hopper one by one to the printing section of the printer;

intermediate roller pair positioned between the platen and the sheet feed roller, the intermediate roller pair being rotated in a normal direction through the gear transmission mechanism irrespective of rotational direction of the platen for providing a sheet slack at a leading end portion of the cut sheet when the platen is rotated in a reverse direction;

and wherein the gear transmission mechanism comprising a swing arm pivotally movable in accordance with the direction of rotation of the platen;

a swing gear rotatably provided to the swing arm for rotating the intermediate roller pair in the normal direction when the platen is rotated in the normal direction; and a transmission gear provided with a one-way clutch idly rotatable when the platen is rotated in the normal direction to shut off power transmission to the intermediate roller pair and to transmit rotation to the intermediate roller pair when the platen is reversely rotated.

15. The automatic sheet feeder as claimed in claim 2 wherein the printer includes a platen positioned behind the sheet insertion section, and wherein the automatic sheet feeder further comprises a resilient first cut-sheet guide means provided between the hopper and the platen and positioned in confrontation with the sheet feed mechanism for feeding the cut sheet in the hopper toward the platen, the first cut-sheet guide means being directed to the sheet insertion section.

16. The automatic sheet feeder as claimed in claim 15 further comprising a resilient second cut-sheet guide means provided between the sheet discharge section and the stacker for directing printed cut sheet to the stacker.

17. The automatic sheet feeder as claimed in claim 16, further comprising a rear frame for supporting the hopper, a cut sheet guide member directing toward the platen, the resilient first cut-sheet guide means having a rear end fixed to the rear frame and a front end positioned in a vicinity of the sheet guide member.

18. The automatic sheet feeder as claimed in claim 17, further comprising a front wall which covers the hopper, and a manual insertion guide member positioned over the platen, and wherein the stacker comprises a tray having a rear plate, a manual sheet insertion section being defined between the front wall and the rear plate, and the manual insertion guide member being positioned in the manual sheet insertion section, the resilient second cut sheet guide means having one end fixed to the manual insertion guide member and another end in abutment with the rear plate.

19. An automatic sheet feeder for use in a printer having a print assembly, a drive source and sheet feed means which supplies a continuous-form sheet to the print assembly comprising:

a side frame;

a hopper supported on the side frame for accommodating cut sheets in a stack and having a sheet feed mechanism for supplying the cut sheet one by one to the print assembly;

a stacker for accommodating printed cut sheets, said stacker having upward and downward pivotal positions, the hopper and the stacker being assembled to the printer;

a gear transmission mechanism for rotatably driving the sheet feed mechanism by the drive source of the printer;

position control means provided on the side frame for regulating upward and downward pivotal positions of the stacker and an interlink mechanism for achieving ON/OFF control with respect to a power transmission to the sheet feed mechanism through the gear transmission mechanism in accordance with a movement of the position control means.

20. An automatic sheet feeder for use in a printer which includes a drive source, a sheet insertion section, a printing section, a sheet feed means for feeding a continuous-form sheet and a sheet discharge section, the sheet feeder including a hopper in which a stack of cut sheets are stored, and a stacker for storing printed cut sheets thereon, the automatic sheet feeder having a first sheet feed mode for supplying the cut sheet stored in the hopper to the sheet insertion section and a second sheet feed mode for supplying a sheet other than the sheet in the hopper, the automatic sheet feeder comprising:

the stacker provided pivotably movable between an operative position where the stacker is positioned adjacent to the sheet discharge section of the printer for receiving in the stacker the printed cut sheet printed at the printing section and a spaced position away from the sheet discharge section; and, select means for selecting the sheet feed mode of the automatic sheet feeder in response to the position of the stacker.

* * * * *